US008608757B2

(12) United States Patent
Iwegbu

(10) Patent No.: US 8,608,757 B2
(45) Date of Patent: Dec. 17, 2013

(54) APPARATUS AND METHOD FOR HAIR REMOVAL

(76) Inventor: Natasha Iwegbu, Washington, DC (US)

( * ) Notice: Subject to any disclaimer, the term of this patent is extended or adjusted under 35 U.S.C. 154(b) by 0 days.

(21) Appl. No.: 12/959,861

(22) Filed: Dec. 3, 2010

(65) Prior Publication Data

US 2012/0143214 A1 Jun. 7, 2012

(51) Int. Cl.
*A61B 17/50* (2006.01)

(52) U.S. Cl.
USPC ..... 606/133

(58) Field of Classification Search
USPC ..... 606/131, 133; 132/122, 214, 323
See application file for complete search history.

(56) References Cited

U.S. PATENT DOCUMENTS

| | | | | |
|---|---|---|---|---|
| 1,588,387 | A * | 6/1926 | Leong et al. | 606/133 |
| 5,951,573 | A * | 9/1999 | Yashar | 606/133 |
| 2009/0030430 | A1 * | 1/2009 | Levi | 606/133 |
| 2012/0089156 | A1 * | 4/2012 | Zangrande et al. | 606/133 |

* cited by examiner

*Primary Examiner* — Tuan V Nguyen
(74) *Attorney, Agent, or Firm* — Henry J. Recla

(57) ABSTRACT

An apparatus and method for removing hair from the surface of skin may include two elongate elements entwined with one another whereby a local mutual twist is formed along the length of the elements. Each of the elements may be held in place and put into tension by a respective one of two structural members. A method for removing hair may include moving the two structural members with the elements in tension, bringing the bottom end of one member closer to the bottom end of the second member such that the coil travels toward the bottom ends of the elements, and then bringing the top end of one member closer to the top end of the second member, such that the coil travels toward the top ends of the elements. As the coil travels between the top and bottom ends of the elements, it extracts hairs from the skin.

28 Claims, 37 Drawing Sheets

APPARATUS AND METHOD FOR HAIR REMOVAL

BACKGROUND

This invention relates generally to a depilatory device and technique. More specifically the invention relates to a hand held depilatory device with a string twisting mechanism.

The need for selective hair removal has existed for centuries now. For females the removal of unwanted facial, arm and leg hair has been crucial in meeting standards of beauty laid out by society, in most parts of the world.

For this reason many methods of hair removal have been practiced. Shaving is probably the most widely and frequently used method of hair removal in both males and females. Although this method is simple and effective, the hairs are cut off at the surface level of the skin. Re-growth occurs in as little as 24 hours and the new hairs tend to feel thicker and brittle due to the angle at which they were severed. This creates a very undesirable result especially for females where a continuous effort is required to keep specific areas of the skin smooth and hair free. Further, the continuous friction of the shaving device against the skin surface can cause local irritation of the dermis.

Waxing and sugaring are methods where a layer of wax or molten sugar is smeared onto the dermis and where the sticky substance adheres to the hairs. The wax is later removed, thereby removing the hairs from the root. Although effective, waxing is a messy process requiring a certain level of skill by the user in order to complete the job to a satisfactory level. In addition hot wax is painful to apply and can damage delicate skin.

Tweezing, a method of seizing and manually extracting hairs has been used. Due to the fact this method removes individual hairs one at a time, it is employed mainly to remove and shape eyebrow and other areas where only a small amount of hair removal is required. It is painful, time consuming and impractical for removal of hair in any significant quantity (e.g., large areas of hair).

Chemical depilation is where a chemical cream is spread over the surface of the skin and the chemical attacks the makeup and structure of the hair. This method employs the use of harsh chemicals, which is not suitable for sensitive skin types. In addition, continuous use of harsh chemicals is dangerous for the skin. Further, hairs are not removed from the root and so hair regrowth occurs rapidly.

Threading is a method whereby a piece of thread is folded and twisted forming an intertwined or coiled section. The thread is then manipulated to cause the coiled section to move along the length of the thread. The coil formation picks up hairs from the surface of the skin as it travels and extracts them from the root. This method requires a skilled individual who understands how to manipulate the thread correctly to create the coiled section and control its movement. Traditionally an individual employs a skilled person to perform the threading, and so it is usually a service that is performed in salons.

Due to the fact that hair removal has been employed since the beginning of modern industrial society, there is a large body of empirical data that suggests that the most successful depilatory devices are the ones that give the user the most control. The surface of the skin where hair can be found is subject to so many contours and indentations and as such, companies that produce the top selling shavers are ones that allow the device to effectively follow those contours and get into crevices where there may be hair growth. For this reason cumbersome or bulky devices usually become extinct quickly with the user opting for simpler, lighter, and smaller devices that can be easily maneuvered over all parts of the skin where there may be unwanted hair growth, as well as allowing the user good visibility, which is usually required to achieve a satisfactory result and promote user comfort.

Hair removal also poses a high risk of infection. With shaving there is a substantially high probability of cutting the skin surface. Such is the case with other methods such as waxing and plucking where the hair is being removed from the root, the dermis is being disrupted, and bleeding has been known to occur. For this reason an important issue surrounding hair removal is that of hygiene.

Thus it is apparent that there is a need for an invention that provides simple, fast, clean, chemical free and effective hair removal method that can be performed by unskilled individuals on themselves. Further there is a need for a device that is light and easy to maneuver over the surface of the skin. In addition there is a need for a device that is hygienic, can be disposable or partially disposable and/or easily disinfected and recyclable.

The foregoing objects and advantages of the invention are illustrative of those that can be achieved by the various exemplary embodiments and are not intended to be exhaustive or limiting of the possible advantages which can be realized. Thus, these and other objects and advantages of the various exemplary embodiments will be apparent from the description herein or can be learned from practicing the various exemplary embodiments, both as embodied herein or as modified in view of any variation which may be apparent to those skilled in the art. Accordingly, the present invention resides in the novel methods, arrangements, combinations, and improvements herein shown and described in various exemplary embodiments.

SUMMARY

In light of the present need for an apparatus for the removal of unwanted hair, a brief summary of various exemplary embodiments is presented. Some simplifications and omissions may be made in the following summary, which is intended to highlight and introduce some aspects of the various exemplary embodiments, but not to limit its scope. Detailed descriptions of preferred exemplary embodiments adequate to allow those of ordinary skill in the art to make and use the invention will follow in later sections.

BRIEF DESCRIPTION OF THE DRAWINGS

In order to better understand various exemplary embodiments, reference is made to the accompanying drawings, which are incorporated in and form a part of the specification wherein.

DETAILED DESCRIPTION

Figure 1:
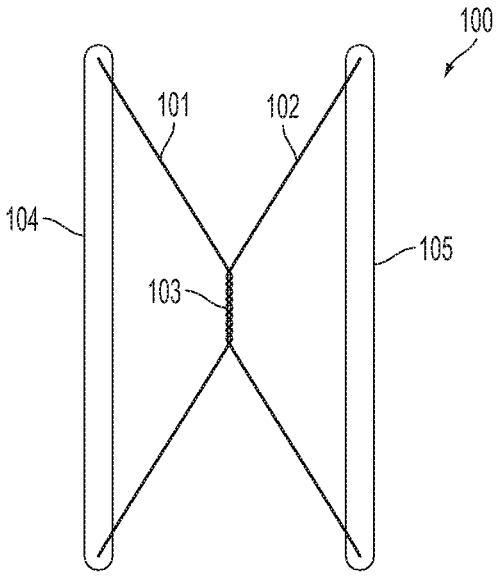
FIG. 1 shows an exemplary embodiment of an apparatus for hair removal.

Referring now to the drawings, in which like numerals refer to like components or steps, there are disclosed broad aspects of various exemplary embodiments. For the sake of brevity, it should be understood that repetitive descriptions of like components or steps indicated by like numerals have, at times, been omitted herein.

FIG. 1 shows an exemplary embodiment of an apparatus [100] for hair removal from the skin's surface, the apparatus having two elongate elements [101, 102]. The elongate elements may be two individual loops or two individual lengths each consisting of a top end and a bottom end. The two elements, whether loops or lengths, are entwined with one another in a coiled manner whereby a local mutual twist [103] is formed along the length of the two elements. Furthermore, in various exemplary embodiments and as shown in FIG. 1, each of the elements are put into tension by a respective one of two structural members [104, 105] where the top end of the structural member dictates the location of the top end of the element and the bottom end of the structure dictates the bottom end of the element. Thus, an exemplary method for removing hair includes creating a rocking movement of the two structural members while the elements are in tension, where the bottom end of one member is brought closer to the bottom end of the second member such that the entwined coil travels toward the bottom ends of the elements. Likewise, when the rocking movement is continued or cycled such that the top end of one member is brought closer to the top end of the second member, the entwined coil travels toward the top ends of the elements. As the coil formation [103] travels between the top and bottom ends of the elements, it picks up hairs from the surface of the skin and extracts them from the root.

In various exemplary embodiments, an apparatus for removing hair from the root comprises two elongate elements entwined and held in tension by two structural members where the members are curved such as to allow room for a user's fingers to ergonomically grip the members. Furthermore, in various exemplary embodiments the curvature of the structural members creates an offset or spacing between the thread assembly and the fingers, which allows the user greater visibility of the hairs as they are being removed. Thus, an exemplary method for removing hair using an apparatus with curved structural members is similar to that described previously with respect to FIG. 1, but with the benefit of having greater visibility of the hairs as they are being removed. The increased visibility may afford greater control and accuracy with regard to the hair removal process.

Figure 2A:
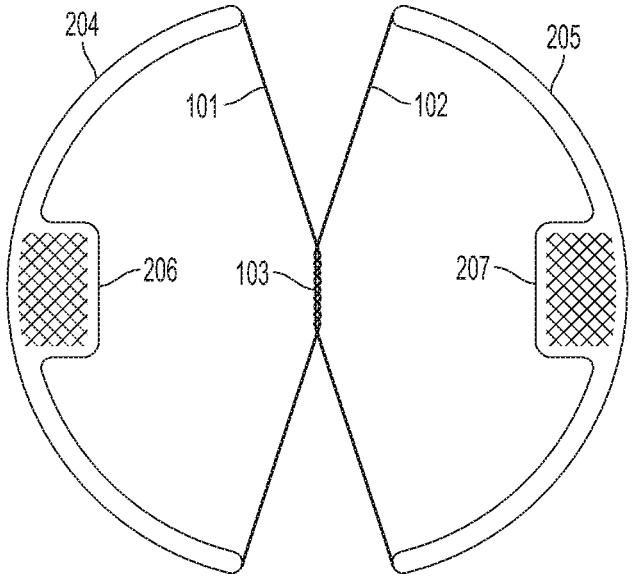
FIGS. 2A and 2B show an exemplary embodiment of an apparatus for removing hair.
Figure 2B:
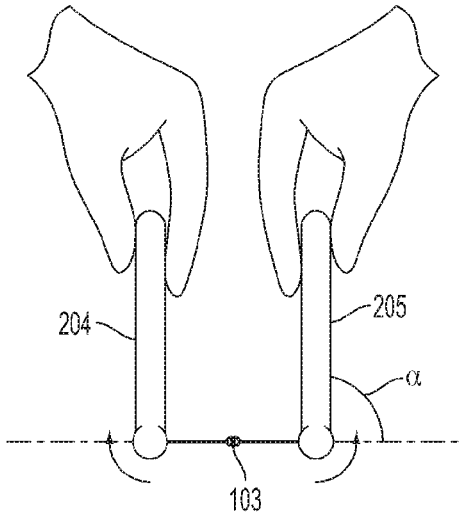

FIGS. 2A and 2B show an exemplary embodiment of an apparatus for removing hair from the root that comprises two elongate elements [101, 102] entwined and held in tension by two structural members [204, 205] where the members are curved and include at least one flat tactile area or secondary bar thereby creating a platform [206, 207] for helping the user's fingers to ergonomically grip the members. The platform provides leverage for the user to rotate the members through an angle $\alpha$ (alpha), as shown in FIG. 2B. Furthermore the platforms [206, 207] may include an etched surface treatment, thereby improving the traction with the user's fingers. Furthermore, in various exemplary embodiments the offset of the elongate elements created by the curvature, coupled with the user's ability to turn the structural members through an angle, allow the user even greater visibility and the ability to get into tight corners where there may be hair growth. Thus, an exemplary method for removing hair using an apparatus having curved structural members is similar to that described previously with respect to FIG. 1, but with the benefit of having greater visibility of the hairs as they are being removed, as well as greater maneuverability of the structural members. The increased visibility may afford greater control and accuracy with regard to the hair removal process, while the increased maneuverability may yield a higher percentage of successful hair removal, particularly in areas of skin folds or creases where there is typically limited clearance for depilatory devices.

In various exemplary embodiments, an apparatus for removing hair from the root may comprise two elongate elements entwined and held in tension by two structural members where the members are curved and consist of at least one slip resistant surface such that the user's fingers can ergonomically and robustly grip the members, thereby providing traction and further leverage for the user to control and rotate the members through an angle using their fingers. The tactile slip resistant surface may be created, for example, by protruding bumps, an etched or indented surface, a rubberized surface, applying a sticky agent, or any other method suitable to create greater traction. In another exemplary embodiment, the tactile slip resistant surface may be combined with the platform [206, 207] shown in FIG. 2A, in order to provide even greater traction for the user's fingers.

Figure 3A:
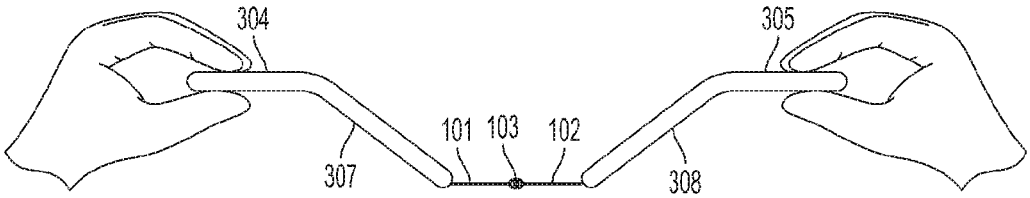
FIGS. 3A and 3B show an exemplary embodiment of an apparatus for removing hair.
Figure 3B:
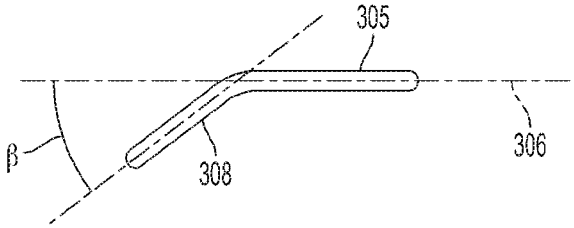

FIGS. 3A and 3B show an exemplary embodiment of an apparatus for removing hair from the root, the apparatus having two elongate elements [101, 102] entwined and held in tension by two structural members [304, 305] where the members are each formed by curving or bending a middle portion in one plane [306] while the top end and bottom end of each structural member are formed with a secondary deflection [307, 308] out of the first plane [306] such that they are offset into respective second and third planes that intersect the first plane [306] at an angle, β (beta) as shown in FIG. 3B. The above described form allows additional room for the user's fingers to ergonomically grip the members, while the secondary offset moves the elongate element arrangement away from the user's fingers, thereby allowing the elongate element assembly to protrude in a fourth plane (best seen in FIG. 3A) that is offset from and substantially parallel to the first plane [306], thus providing improved clear access to the skin by the element assembly. Furthermore, in various exemplary embodiments a surface treatment may be added to a central portion of the structural members [304, 305] to create better traction. An exemplary method for removing hair includes causing a rocking movement of the two structural members [304, 305] while the elements [101, 102] are in tension, where the bottom end of one member is brought closer to the bottom end of the second member such that the entwined coil travels to the bottom ends of the elements. Likewise, when the rocking movement is continued or cycled such that the top end of one member is brought closer to the top end of the second member, the entwined coil travels to the top ends of the elements. As the coil formation [103] travels between the top and bottom ends of the elements, it picks up hairs from the surface of the skin and extracts them from the root.

Figure 4A:
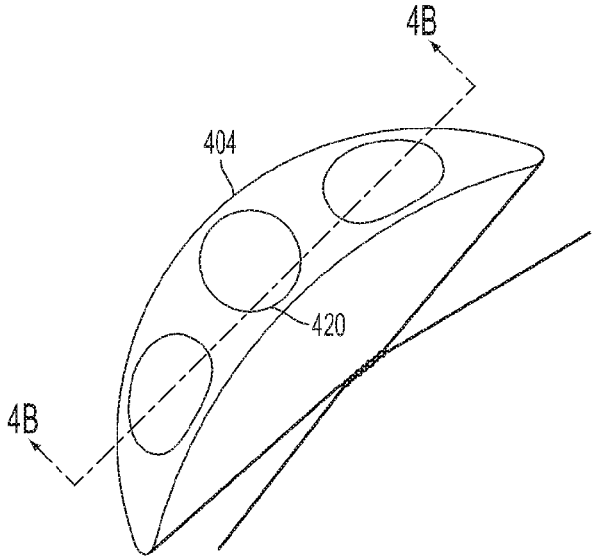
FIGS. 4A through 4C show exemplary embodiments of a structural member that may be included as part of an apparatus for removing hair.
Figure 4B:
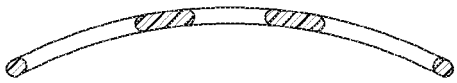
Figure 4C:
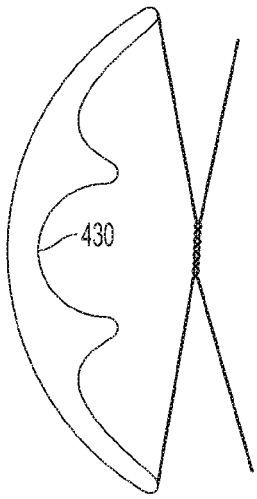

FIGS. 4A through 4C show exemplary embodiments of a structural member that may be included as part of an apparatus for removing hair from the root. The structural member [404] consists of a beam, and a surface or surfaces that are curved in two orthogonal planes. Further in various exemplary embodiments the structural member may include holes or grooves such that there is room for the user's fingers to enter the holes or sit within the grooves and ergonomically grip the members. The central hole or groove [420, 430] may act as a pivot promoting a rocking movement about the user's finger. Furthermore, in various exemplary embodiments the central hole may act as a thumb rest, while the two offset holes may act as finger rests providing the user greater ability to maneuver and leverage to turn the members through an angle, thus allowing even greater visibility and the ability to get into tight corners where there may be hair growth. Thus, an exemplary method for removing hair using an apparatus having curved structural members [404] is similar to that described previously with respect to FIG. 3, but with the benefit of having greater maneuverability of the structural members. The increased visibility may afford greater control and accuracy with regard to the hair removal process, while the increased maneuverability may yield a higher percentage of successful hair removal, particularly in areas of skin folds or creases where there is typically limited clearance for depilatory devices. The presence of holes or grooves may promote a rocking movement about the user's finger, as well as a place for the user's fingers to enter the holes or sit within the grooves and ergonomically grip the members.

Figure 5A:
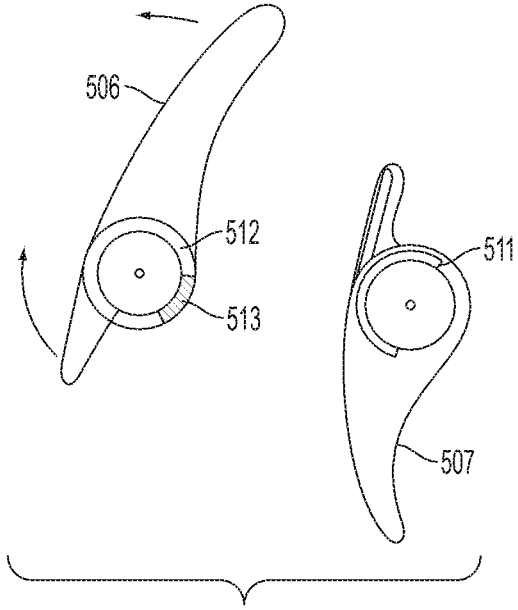
FIGS. 5A through 5D show exemplary embodiments of an apparatus for removing hair.
Figure 5B:
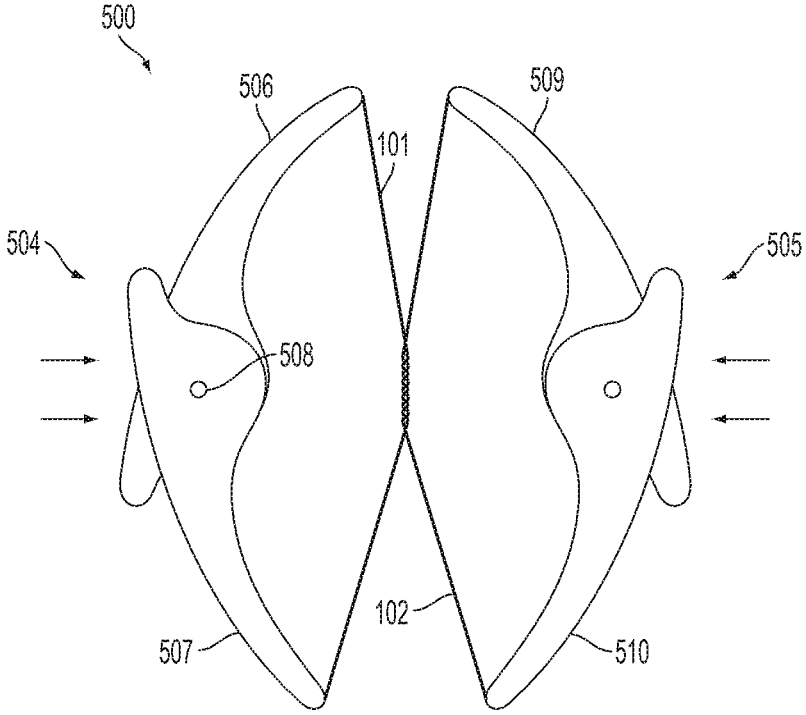

FIGS. 5A and 5B show an exemplary embodiment of an apparatus [500] for removing hair from the root that comprises two elongate elements [101, 102] entwined and held in tension by two structural members [504, 505] where the first structural member [504] further comprises a left top structural member [506] connected to a left bottom structural member [507] via at least one pivot [508], and the second structural member [505] further comprises a right top structural member [509] connected to a right bottom structural member [510] via at least one pivot. The top of the left elongate element [101] is attached to the left top structural member [506] and the bottom of the left elongate element is attached left bottom structural member [507]. The top of the right elongate element [102] is attached to the right top structural member [509] and the bottom of the right elongate element is attached to the right bottom structural member [510]. The first and second structural members [504, 505] may be configured to be mirror images of one another. The top and bottom halves of a structural member can be rotated relative to one another about the pivot [508], thus adjusting the relative angle between the top and bottom halves of the left or right member assemblies, which in turn will adjust the tension of the elongated elements [101, 102] by adjusting the end portions of the structural members. Furthermore, a spigot or insert [511] and channel [512] arrangement on the top and bottom structural members, respectively, including one or more channel stops [513], prevent the aforementioned angle from adjusting past an acceptable, predetermined point, to ensure proper operation of the apparatus [500]. Furthermore, the top and bottom structural members may extend in length beyond the connection at the pivot point [508], thereby creating an overlap condition in the central portion of the structural member. Applying pressure onto the overlapping region allows for easy control and adjustment of the angle between the top and bottom halves of the structural member.

Figure 5C:
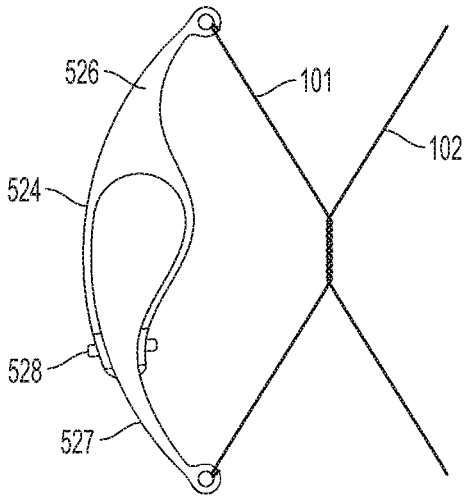
Figure 5D:
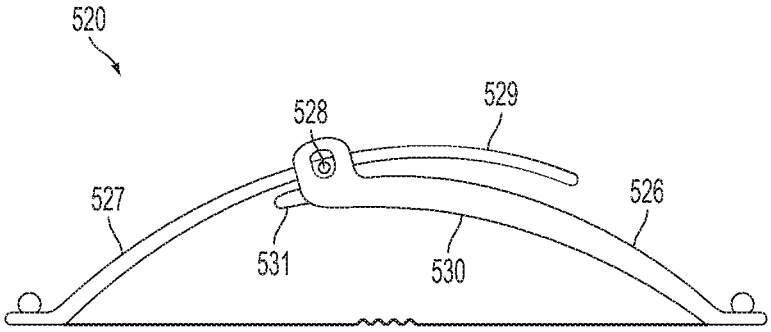

FIGS. 5C and 5D show an exemplary embodiment of an apparatus [520] for removing hair from the root that comprises two elongate elements [101, 102] entwined and held in tension by two structural members [524] where the first structural member [524] further comprises a left top structural member [526] connected to a left bottom structural member [527] via at least one pivot [528], and the second structural member [not shown] further comprises a right top structural member connected to a right bottom structural member via at least one pivot. The top of the left elongate element [101] is attached to the left top structural member [526], and the bottom of the left elongate element is attached to the left bottom structural member [527]. The top of the right elongate element [102] is attached to the right top structural member (not shown), and the bottom of the right elongate element is attached to the right bottom structural member (not shown). The first and second structural members [524] may be configured to be mirror images of one another. The top and bottom halves of a structural member can be rotated relative to one another about the pivot [528] by applying pressure on press plates [529, 530], thus adjusting the relative angle between the top and bottom halves of the left or right member assemblies, which in turn will adjust the tension of the elongated elements [101, 102] by adjusting relative positions of the first and second end portions of the structural members. Furthermore, a protrusion [531] located on the top structural member [526] prevents the aforementioned angle from adjusting past an acceptable, predetermined point, to ensure proper operation of the apparatus [520]. Applying pressure onto the press plates [529, 530] region allows for easy control and adjustment of the angle between the top and bottom halves of the structural member.

Figure 6A:
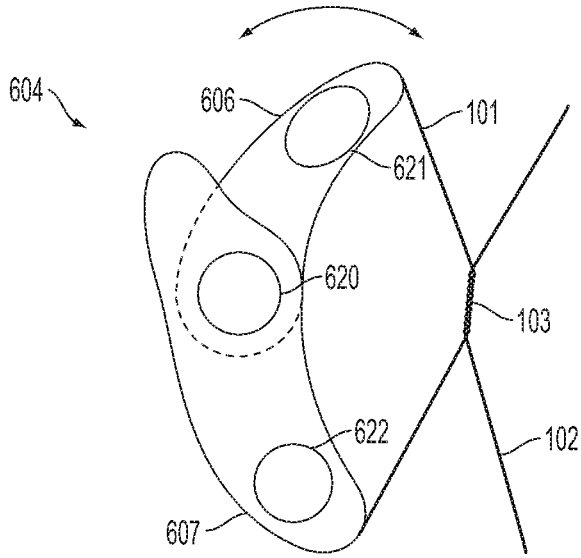
FIGS. 6A and 6B show exemplary embodiments of a structural member that may be included as part of an apparatus for removing hair.
Figure 6B:
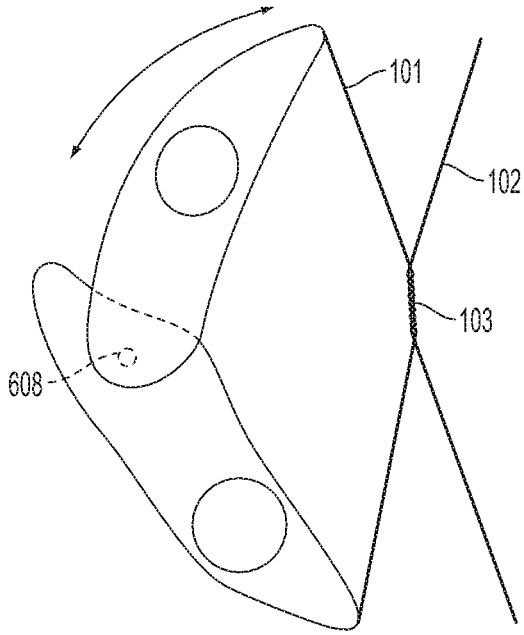

FIGS. 6A and 6B show exemplary embodiments of a structural member [604] that may be included as part of an apparatus for removing hair from the root. The left structural member assembly [604] comprises a left top structural member [606] connected to a left bottom structural member [607] via at least one pivot [608]. A counterpart right structural member assembly (not shown) includes a right top structural member connected to a right bottom structural member via at least one pivot. The top of a left elongate element [101] can be attached to the left top structural member, and a bottom of the left elongate element can be attached to the left bottom structural member. The top of a right elongate element [102] can be attached to the right top structural member (not shown), and the bottom of the right elongate element can be attached to the right bottom structural member (not shown). Furthermore, in various exemplary embodiments, the left or right structural member pivot may be formed as or created by a hole [620], in which the user can insert their finger and thus control and maneuver the apparatus. Furthermore the top and bottom halves of the structural members may consist of holes [621, 622] in which the user can insert fingers to provide better control to maneuver relative angle adjustment of the top and bottom halves of the structural member assembly. Adjusting the angle between the top and bottom halves of the left or right structural member assemblies serves to adjust the tension of the elongated elements, by adjusting relative positions of the first and second end portions of the structural members.

Figure 7A:
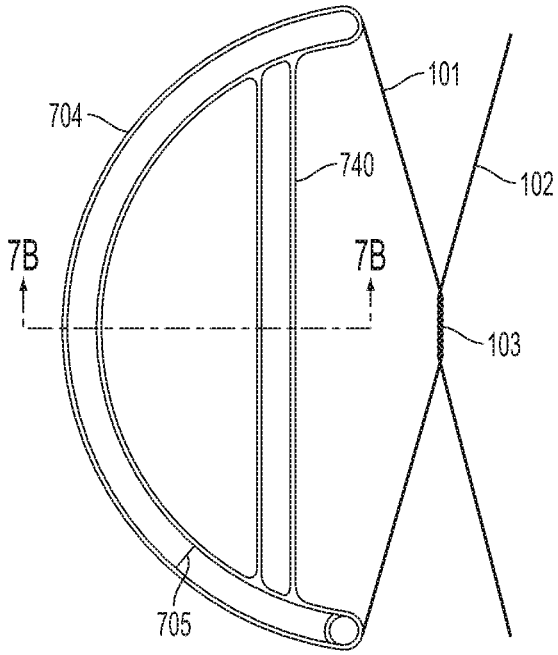
FIGS. 7A through 7D show exemplary embodiments of an apparatus for removing hair.
Figure 7B:
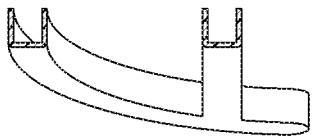
Figure 7C:
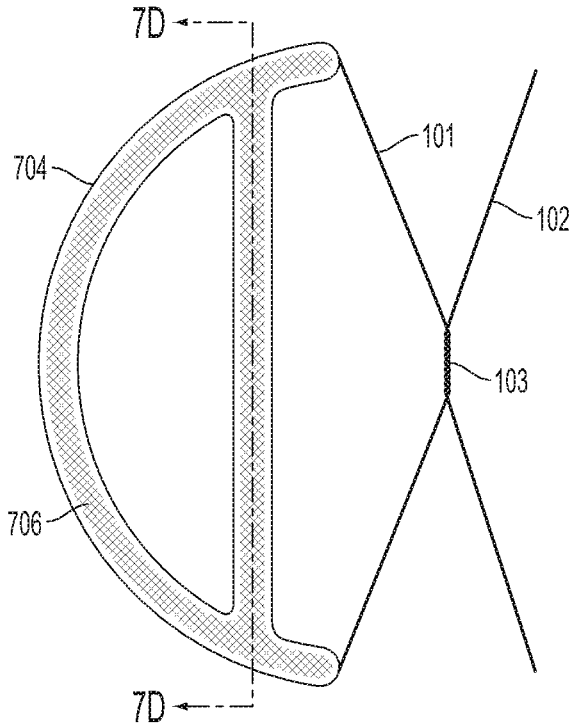

FIGS. 7A through 7D show exemplary embodiments of an apparatus for removing hair from the root, where the apparatus includes left [101] and right [102] elongate elements entwined and held in tension by left [704] and right structural members respectively, where the members are curved and consist of at least one crossbar arrangement [740]. The aforementioned crossbar is connected close to the top and bottom ends of one or both of the structural members [704] so as to reinforce the structural member, therefore preventing it from buckling inwards under the stress of taut elongate elements. Furthermore, the crossbar [740] provides a secondary surface defining a plane, thereby allowing the user to grip and maneuver the structural member through an angle. Furthermore, the structural member configuration could employ an open channel having a U-shaped cross section, as shown in FIG. 7B, where the hollow channel may be stiffened by one or more thin ribs [705] that are placed orthogonally to the channel flanges and periodically along the length of the channel. This arrangement can provide a design that is very rigid, economical in terms of material use, and lightweight. Furthermore the structural members may be etched [706], notched or treated with a secondary (e.g., rubberized) material to improve traction and allow the user to firmly grip the apparatus.

In various exemplary embodiments, an apparatus for removing hair from the root may include left and right elongate elements entwined and held in tension by left and right structural members respectively, where the members are curved and consist of at least one curved crossbar arrangement where opposing ends of the member curvature are connected by the crossbar. In this configuration, the crossbar adds structural value and serves to prevent the top and bottom ends of the curved member from buckling inwards during operation or use of the apparatus. When the aforementioned curved crossbar and the structural member are compressed, the top and bottom ends of the member are deflected out further away from one another, thereby adjusting the tension of the elongated elements. Further, in various exemplary embodiments the aforementioned left and right structural members may include a notch formed in the center of each structural member, to aid the outward deflection.

Figure 8A:
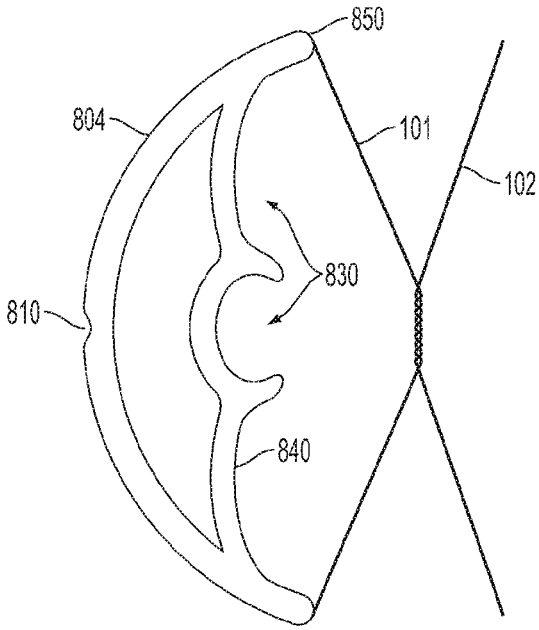
FIGS. 8A and 8B show exemplary embodiments of a structural member that may be included as part of an apparatus for removing hair.
Figure 8B:
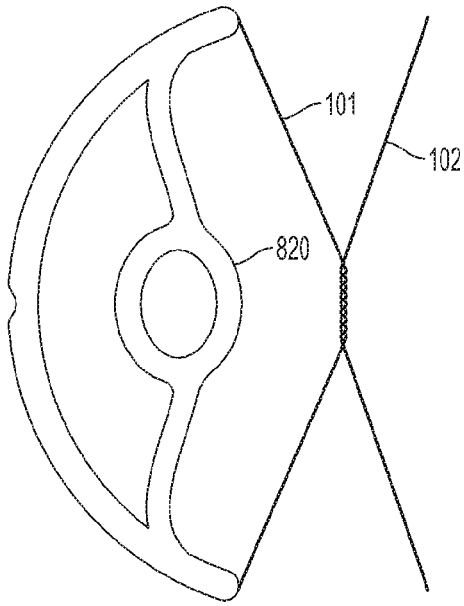

FIGS. 8A and 8B show exemplary embodiments of a structural member [804] that may be included as part of an apparatus for removing hair from the root. The structural member [804] includes a curved crossbar [840] that may be similar to that described previously, and further includes one or more finger holes [820] or grooves [830] that will enable the user to engage their fingers and more easily grip and compress the crossbar or crossbeam [840]. An exemplary embodiment of an apparatus for removing hair may include a bulb or bulbous tip [850] at the top and bottom ends of each structural member [804], where each elongate element [101] is melded with or integrally attached to the respective structural member [804]. The crossbar [840] can add structural value and can prevent the top and bottom ends of the structural member from buckling inward as a result of tension in the elongate element [101]. When the crossbar [840] and the structural member [804] are compressed, the top and bottom ends of the structural member are deflected out further away from one another, thereby adjusting the tension of the elongate elements [101, 102] of the hair removal apparatus by adjusting the relative distance between end portions of the structural members. Further, in various exemplary embodiments the aforementioned left and right structural members may include a notch [810] located at or near their respective centers to aid user-initiated outward deflection or buckling of the structural member [804].

Figure 9A:
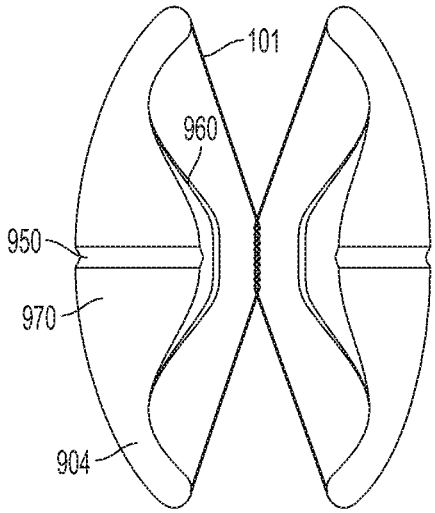
FIGS. 9A and 9B show an exemplary embodiment of a structural member that may be included as part of an apparatus for removing hair.
Figure 9B:
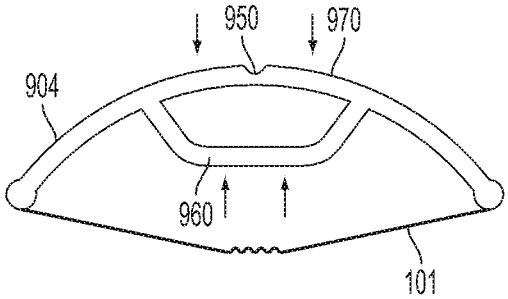

FIGS. 9A and 9B show an exemplary embodiment of a structural member [904] that may be included as part of an apparatus for removing hair from the root. The structural member [904] is curved in two orthogonal planes and includes an arrangement where opposing portions of the structural member's curvature are connected by a secondary surface [960]. The surface [960] can add structural value and can prevent the top and bottom ends of the structural member from buckling inwards as a result of tension in the elongate element [101]. When the secondary surface and the structural member are compressed, the top and bottom ends of the member [904] are deflected out further away from one another, thereby adjusting the tension of the elongated elements [101] of the hair removal apparatus by adjusting the relative distance between end portions of the structural members. Further, in various exemplary embodiments the aforementioned left and right structural members may include a notch [950] located at or near their respective centers to aid outward deflection or buckling of the structural member [904] when the structural member and secondary surface [960] are compressed toward one another.

In various exemplary embodiments, an apparatus for removing hair from the root may comprise two elongate elements entwined, a left structural member, a right structural member, a left rotating spindle-type element movably connected to the top of the left structural member, a right rotating spindle-type element movably connected to the top end of the right structural member, where the left rotating spindle is attached to the top end of the left elongate element and the right rotating spindle is attached to the top end of the right elongate element. The structural members put into tension each of the elongate elements and the bottom end of the structural member dictates movement of the bottom end of the elongate element, as well as the resulting change in tension of the elongate element. Furthermore, in various exemplary embodiments, rotation of the left and right spindles via a ratchet mechanism adjusts the tension of the elongate elements, thereby adjusting the control the user has during hair removal.

Figure 10:
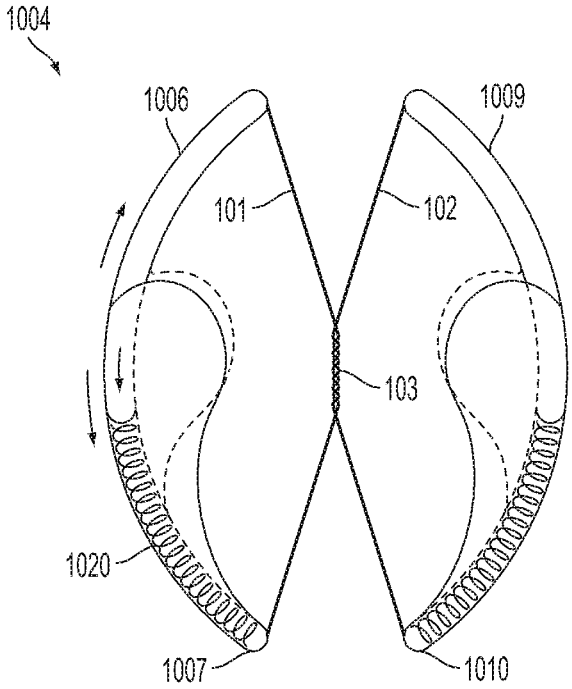
FIG. 10 shows an exemplary embodiment of a structural member that may be included as part of an apparatus for removing hair.

FIG. 10 shows an exemplary embodiment of a structural member [1004] that may be included as part of an apparatus for removing hair from the root. The apparatus may comprise two elongate elements [101, 102] entwined at a mutual twist [103], a left outer structural member [1007] connected to the bottom of the left elongate element [101], a left inner structural member [1006] connected to the top of the left elongate element, a right outer structural member [1010] connected to the bottom of the right elongate element [102], and a right inner structural member [1009] connected to the top of the right elongate element. The inner and outer structural members may be straight or may be formed with concentric curvatures. Further the cross-section of the inner and outer members may be non-circular, where the left outer member is arranged in a telescopic fashion with respect to the left inner structural member, and the right outer member is arranged in a telescopic fashion with respect to the right inner structural member. A secondary surface may be added to the outer members. A secondary surface may be additionally or alternatively added to the inner structural members. The aforementioned surfaces may be flat or curved. The left and right structural member assemblies put into tension each of the elongate elements, where the top end of a structural member assembly dictates the location of the top end of the element and the bottom end of the structural member assembly dictates location of the bottom end of the element. The sliding telescopic action of the left or right member assemblies adjusts the tension of the elongate elements by adjusting relative positions of the first and second end portions of the structural members. Furthermore, in various exemplary embodiments, the inner and outer member telescopic arrangement may include a spring [1020] and may be spring-loaded, thereby serving to adjust the tension of the attached elongate elements.

Figure 11A:
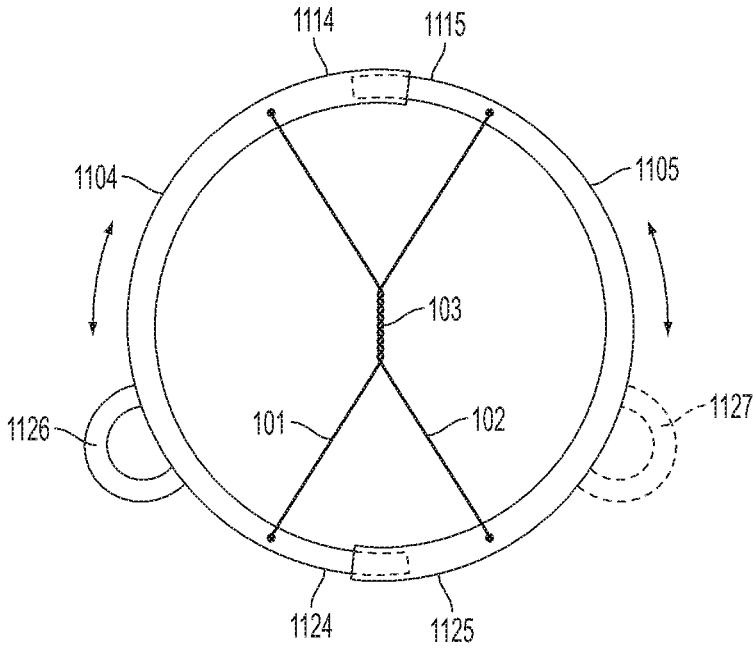
FIG. 11A through 11E show exemplary embodiments of an apparatus for removing hair.

FIG. 11A shows an exemplary embodiment of an apparatus for removing hair from the root that comprises two elongate elements [101, 102] entwined at a mutual twist [103], a left structural member [1104] of suitable curvature, and a right structural member [1105] of suitable curvature. The left and right structural members put into tension each of the elongate elements, where the top end of a structural member dictates the location of the top end of the respective element and the bottom end of a structural member dictates the bottom end of the respective element. The right structural member [1105] includes a male interlocking portion [1115] at a top or bottom end that is designed to slide into a corresponding female interlocking portion [1114] of the left structural member [1104]. The right structural member [1105] further includes a female interlocking portion [1125] at a top or bottom end—i.e., opposite the end having the male interlocking portion [1115]—that is designed to receive a corresponding male interlocking portion [1124] of the left structural member [1104]. The curvature of the left and right structural members [1104, 1105] may be such that the two members form a circle when the respective top and bottom ends are nested or interlocked. An exemplary method of removing hair includes the respective sliding of the left and right structural members into one another in a telescopic action, while the elongate elements [101, 102] are held in tension, where the bottom end of one structural member is further nested within the bottom end of the second member such that the entwined coil [103] travels toward the bottom ends of the elongate elements. Likewise, when the top end of one structural member is further nested within the top end of the second structural member, the entwined coil [103] is made to travel toward the top ends of the elongate elements, thereby removing entrained hair from the follicle or root.

Figure 11B:
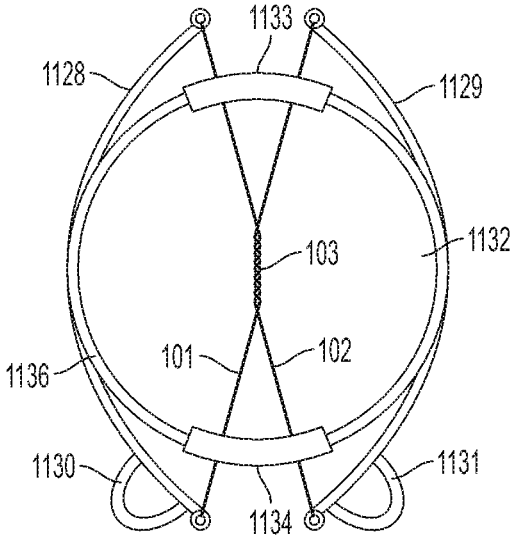
Figure 11C:
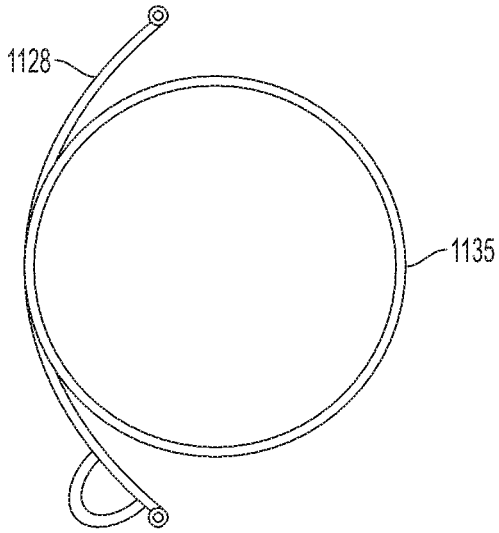
Figure 11D:
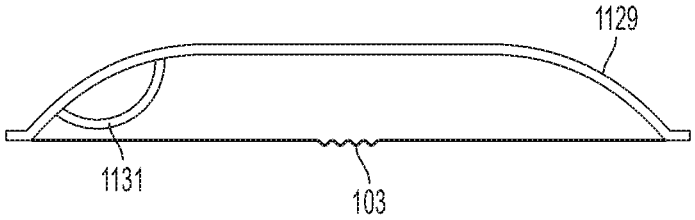

FIGS. 11B through 11D Show an exemplary embodiment of an apparatus for removing hair from the root that comprises two elongate elements [101, 102] entwined at a mutual twist [103], a left structural member [1128] of suitable curvature, and a right structural member [1129] of suitable curvature. The left and right structural members put into tension each of the elongate elements, where the top end of a structural member dictates the location of the top end of the respective element and the bottom end of a structural member dictates the bottom end of the respective element. The left structural member [1128] may include a ring of suitable radius [1135]. Similarly, the right structural member may include a ring of suitable radius [1136]. The rings on the right and left structural member are assembled such that their centers and radii are aligned [1132], and the rings are held in place by two clips [1133, 1134] such that the left and right structural member may rotate relative to one another. This forms an "open loop pivot' that allows the user an unobstructed visual or view of the action of the mutual twist [103] and therefore the hairs being removed by the twist. The clips [1133, 1134] may be formed of a plastic or other suitable material. Holes [1130, 1131] where the user can insert their fingers may be included on the left and right structural members to allow for one-handed operation. An exemplary method of removing hair may include rotating the right and left structural members relative to one another along their respective rings, while the elongate elements are in tension, where the bottom end of one member is brought closer to the bottom end of the second member such that the entwined coil to travels to the bottom ends of the elongate elements. Likewise, when the top end of one member is brought closer to the top end of the second member the entwined coil to travels to the top ends of the elongate elements, thereby removing entrained hair from the follicle or root. Alternatively, the rings [1135, 1136] may be formed of partial circles that engage and nest with one another in a telescopic action, in a manner similar to that depicted in FIG. 11A.

Figure 11E:
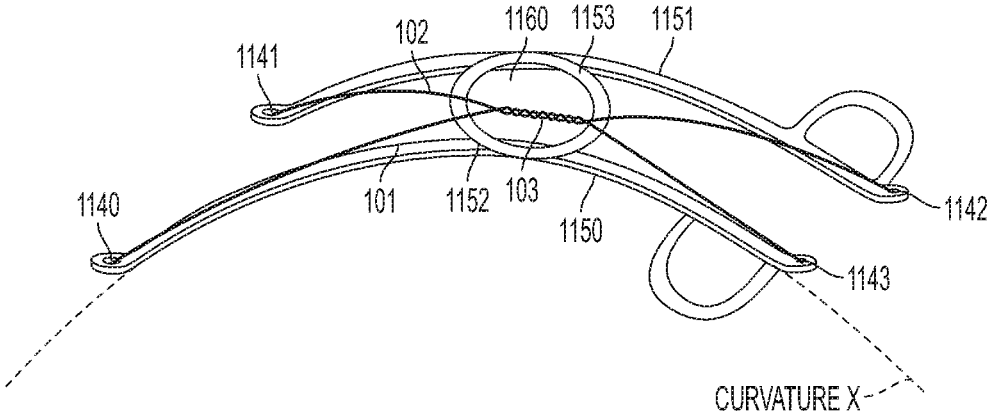

FIG. 11E Shows an exemplary embodiment of an apparatus for removing hair from the root that is similar to 11B. However in this embodiment, the two elongate elements [101, 102] entwined at a mutual twist [103], are attached respectively, to the top and bottom ends of the left and right structural members [1140-1143] such that the elongate element assembly is draped over and rests upon the structural members as shown. The left and right structural members put into tension each of the elongate elements, where the top end of a structural member dictates the location of the top end of the respective element and the bottom end of a structural member dictates the bottom end of the respective element. The left structural member [1150] may include a ring of suitable radius [1152]. Similarly, the right structural member may include a ring of suitable radius [1153]. The rings on the right and left structural member are assembled such that their centers and radii are aligned [1160], and the rings are held in place to form an "open loop pivot' that allows the user an unobstructed visual of the action of the mutual twist [103] and therefore the hairs being removed. The user may place the device near the skin surface where contact will be made at a tangent to the structural member curvature, i.e. the open pivot region where the user can see the action of the mutual twist. As the mutual twist travels along the elongate elements [101, 102] and into the open loop region, it comes in contact with the user's skin and the user's hairs that are targeted for removal. As the mutual twist travels away from the open loop pivot region, the twist path follows the curvature of the structural members and thus moves upwards away from the skins surface and so no further hair removal is allowed. By manipulating the curvature X of the structural members and the size of the loop [1160], the area of skin in contact with the mutual twist is determined and therefore controlled.

In various exemplary embodiments, an apparatus for removing hair from the root may include two entwined elongate elements, a left member of suitable curvature, attached at the top and bottom to a left elongate element, and a right member of suitable curvature attached at the top and bottom to a right elongate element. The left and right members may be mounted on a continuous circular frame and may slide freely along the length of the circular frame. The left and right members may be formed of rigid or flexible material and when mounted on the frame, may put into tension each of the elongate elements. An exemplary method of removing hair includes the sliding of the right and left members along the continuous frame, while the elongate elements are in tension, where the bottom end of one member is brought closer to the bottom end of the second member such that the entwined coil to travels to the bottom ends of the elongate elements. Likewise, when the top end of one member is brought closer to the top end of the second member the entwined coil to travels to the top ends of the elongate elements, thereby removing entrained hair from the follicle or root.

Figure 12A:
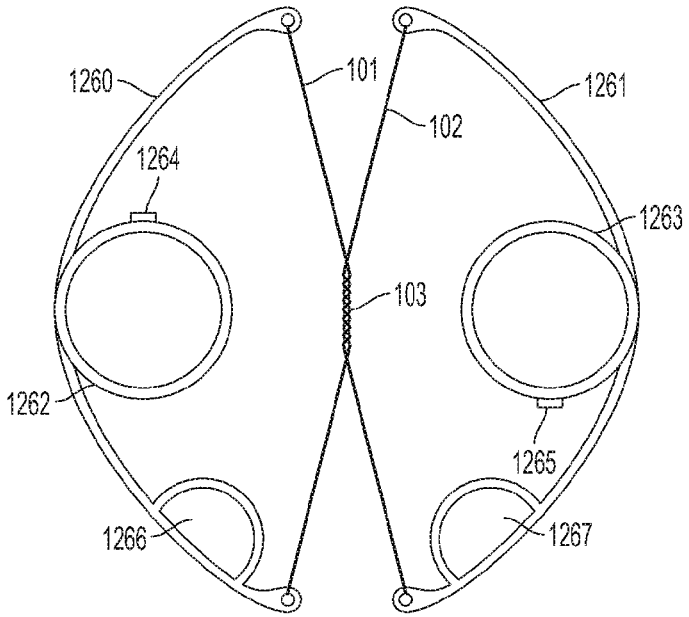
FIGS. 12A through 12D show exemplary embodiments of an apparatus for removing hair.
Figure 12B:
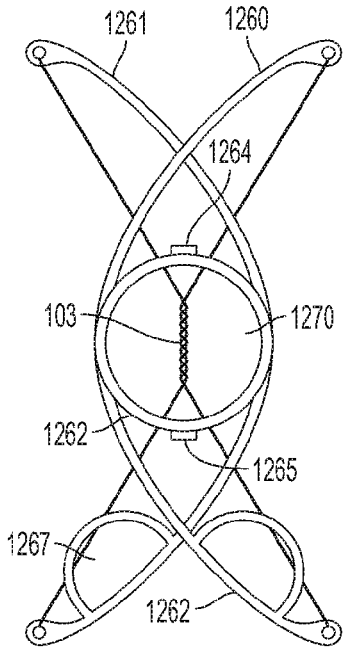

FIG. 12A shows an exemplary embodiment of an apparatus for removing hair from the root that comprises two elongate elements [101, 102] entwined at a mutual twist [103], a left structural member [1260] of suitable curvature, and a right structural member [1261] of suitable curvature. The left and right structural members put into tension each of the elongate elements, where the top end of a structural member dictates the location of the top end of the respective element and the bottom end of a structural member dictates the bottom end of the respective element. The left structural member [1260] may include a ring [1262] of suitable radius. Similarly, the right structural member [1261] may include a ring [1263] having a radius that is equal to that of the left structural member. The left structural member [1260] may include a second ring [1266] of suitable radius. Similarly, the right structural member may include a second ring [1267] having a radius that is equal to the radius of corresponding ring [1266] of the left structural member. The rings [1262, 1263, 1266, 1267] may serve as holes such that there is room for the user's fingers to enter the holes and ergonomically grip the members. The holes formed by central rings [1262, 1263] may act as a pivot promoting a rocking movement about the user's finger. Furthermore, in various exemplary embodiments the central holes may serve as thumb rests, while the other holes may serve as finger rests providing the user greater ability to maneuver, leverage and turn the members through an angle, thus allowing even greater visibility and the ability to get into tight corners where there may be hair growth. FIG. 12B shows the left and right structural members [1260, 1261] assembled such that their respective central holes [1262, 1263] are aligned [1270] and are held in place by two clips [1264, 1265], which may be formed of plastic or another suitable material. This configuration forms an "open loop pivot" where the left and right structural member may rotate relative to one another while allowing the user an unobstructed visual of the action of the mutual twist [103] and therefore of the hairs being removed. The user can insert their fingers into the holes formed by the rings [1266, 1267] on the left and right structural members to allow one-handed operation. Further, finger holes may be present on either side of the center circles [1263, 1264] creating a configuration similar to that shown in FIG. 4A. An exemplary method of removing hair may include rotating the right and left member relative to one another along their respective rings, while the elongate elements are in tension. This embodiment allows the user to use the device in either a two-handed or one-handed operation.

Figure 12C:
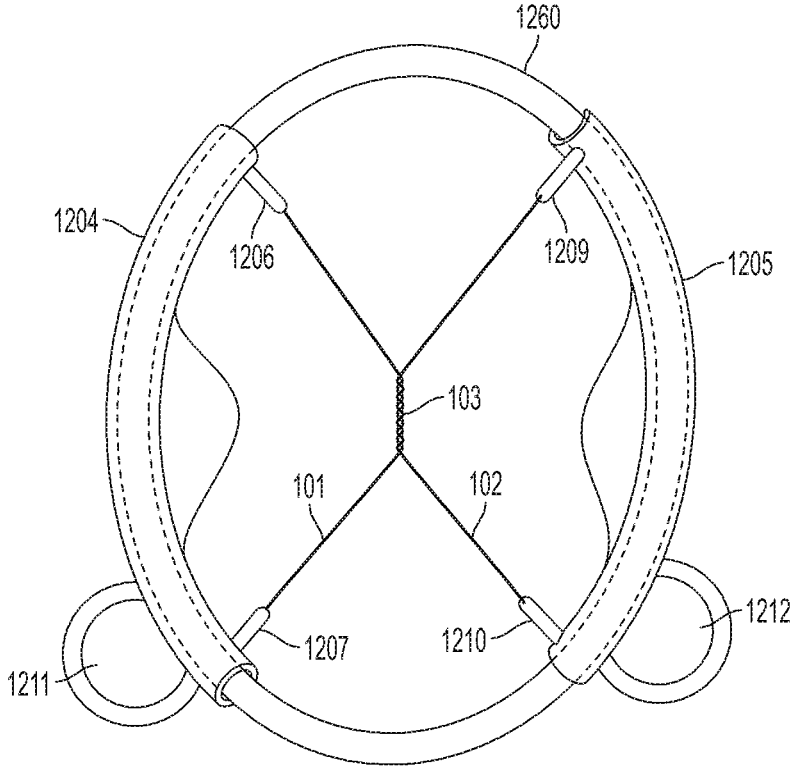
Figure 12D:
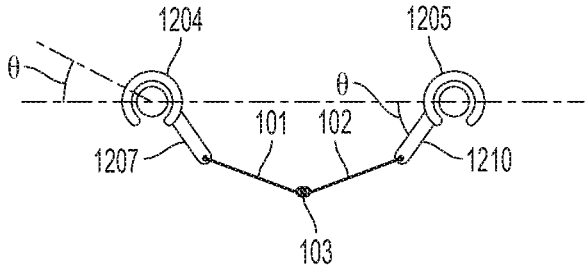

FIGS. 12C and 12D show an exemplary embodiment of an apparatus for removing hair from the root that may include two elongate elements [101, 102] entwined at a mutual coil [103], and left and right structural members [1204, 1205] may be used on their own in a "freestyle" manner or, alternatively, that may be mounted on a continuous circular frame [1260], for one-handed operation. The left structural member [1204] is formed in suitable curvature for sliding along the frame [1260] and may feature top and bottom extreme ends [1206, 1207] that are offset in a plane that forms a relative angle θ (theta) with a plane of the circular frame [1260], as shown in FIG. 12D. Likewise the right structural member [1205] is formed in suitable curvature for sliding along the circular frame and may feature top and bottom extreme ends [1209, 1210] that are offset in a plane that forms a relative angle θ (theta) with a plane of the circular frame [1260]. The left and right structural members put into tension each of the elongate elements. Rings [1211, 1212] that form holes for a user's fingers may also be included in an exemplary embodiment. An exemplary method for removing hair using an apparatus with curved structural members is similar to that described previously with respect to FIG. 11A, but with the added benefit of the extreme ends [1206, 1207, 1209, 1210] being offset from the plane of the circular frame in a direction that tends downward toward the skin, thus positioning the entwined coil relatively closer to the skin. The greater proximity of the coil to the skin may afford greater visibility of the hairs as they are being removed and thus a more effective hair removal process.

Figure 13A:
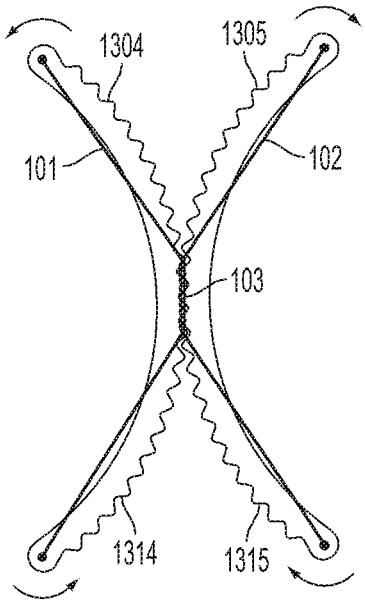
FIGS. 13A and 13B show an exemplary embodiment of an apparatus for removing hair.
Figure 13B:
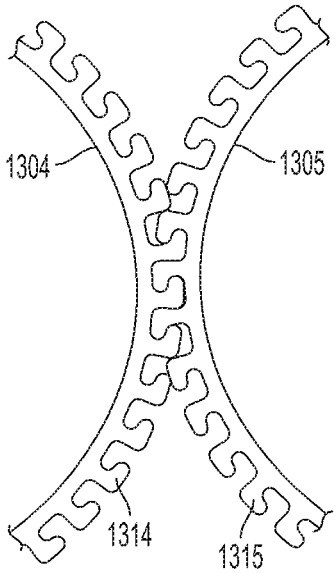

FIGS. 13A and 13B show an exemplary embodiment of an apparatus for removing hair from the root that may comprise left and right elongate elements [101, 102] entwined at a mutual twist or coil [103], a left structural member [1304] of suitable curvature featuring interlocking teeth [1314] along an outer curvature, attached at a top end and a bottom end to the left elongate element [101], and a right structural member [1305] of suitable curvature featuring interlocking teeth [1315] along an outer curvature, attached at a top end and a bottom end to the right elongate element [102], as shown in FIG. 13A. Each member puts into tension a respective one of the elongate elements [101, 102]. Furthermore, in various exemplary embodiments, while the elements are in tension, the teeth of the left and right members are interlocked locally, one corresponding section at a time, as shown in FIG. 13B. An exemplary method for removing hair using an apparatus with two structural members includes causing the left and right structural members to travel along each other's curvature in a rocking fashion, where the bottom end of one structural member is brought closer to the bottom end of the second member such that the entwined coil [103] to travels toward the bottom ends of the elongate elements. Likewise when the top end of one member is brought closer to the top end of the second member, the entwined coil is made to travel toward the top ends of the elongate elements, thereby removing from the hair follicle hair that becomes entrapped or entrained in the coil [103].

Figure 14A:
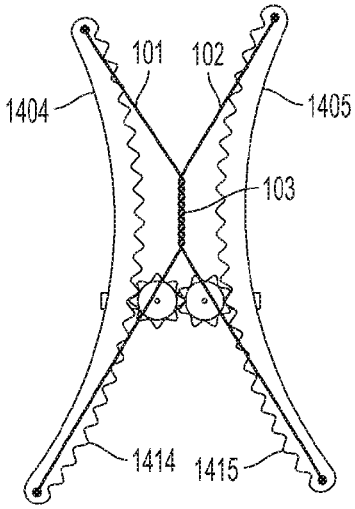
FIGS. 14A through 14C show exemplary embodiments of an apparatus for removing hair.
Figure 14B:
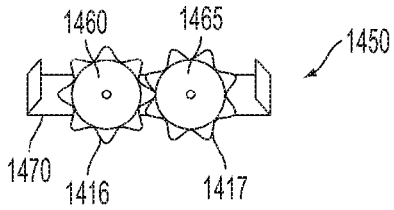
Figure 14C:
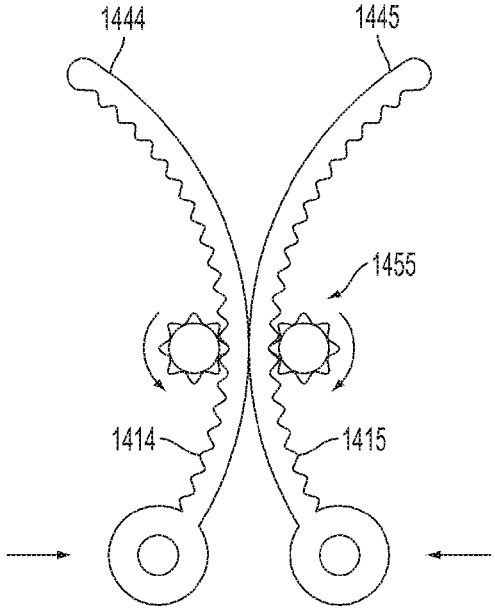

FIGS. 14A through 14C show exemplary embodiments of an apparatus for removing hair from the root that may comprise two elongate elements [101, 102] entwined at a mutual twist or coil [103], a left member [1404] of suitable curvature featuring gear teeth [1414] along its outer curvature, attached at a top and bottom end to the left elongate element [101], and a right member [1405] of suitable curvature featuring gear teeth [1415] along its outer curvature, attached at a top and bottom end to the right elongate element [102], as shown in FIG. 14A. Each member puts into tension, respectively, each of the elongate elements. Furthermore, in various exemplary embodiments, while the elongate elements are held in tension, the left and right members [1404, 1405] are locked locally by a "rider" or locking component [1450]. As illustrated in FIG. 14B, the rider may include two gears [1460, 1465] that are both attached to a plate [1470]. The gears have teeth [1416, 1417] that correspond to the teeth [1414, 1415] located on the outer curvatures of the left and right members [1404, 1405]. The rider [1450] serves as a clamping mechanism that holds together the left and right members [1404, 1405] locally at a point along their curvatures. In an exemplary method of removing hair, as the left and right structural members travel along each other's curvature in a rocking fashion, the rider travels via its rotating gears [1460, 1465] as they engage with the teeth [1416, 1417] along their outer curvatures. As the bottom end of one member is brought closer to the bottom end of the second member, the entwined coil [103] travels to the bottom ends of the elongate elements. Likewise, as the top end of one member is brought closer to the top end of the second member the entwined coil travels to the top ends of the elongate elements, thereby removing from the hair follicle hair that becomes entrapped or entrained in the coil [103].

An exemplary modification to the embodiment illustrated in FIGS. 14A and 14B is shown in FIG. 14C. In this modified embodiment, the teeth [1414, 1415] are located on the inner curvature of the left and right members [1404, 1405]. The locking component or rider [1455] is configured similarly to that shown in FIG. 14B, with the exception that the gear teeth [1416, 1417] engage the teeth [1414, 1415] on the inner curvatures of the left and right members [1444, 1445], respectively. Accordingly, the rider [1455] travels along the inner curvatures of the left and right members [1444, 1445] as the gears [1460, 1465] rotate.

Figure 15A:
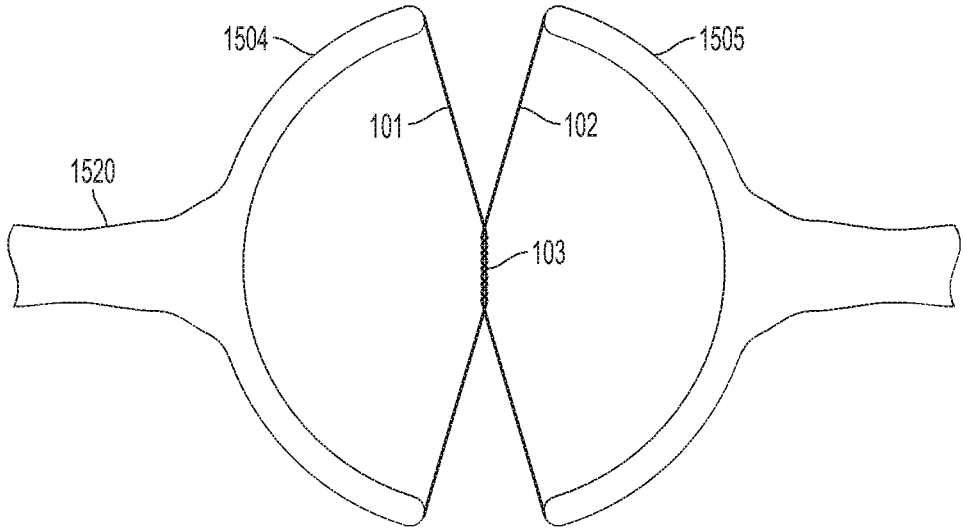
FIGS. 15A through 15C show exemplary embodiments of a structural member that may be included as a component of an apparatus for removing hair.
Figure 15B:
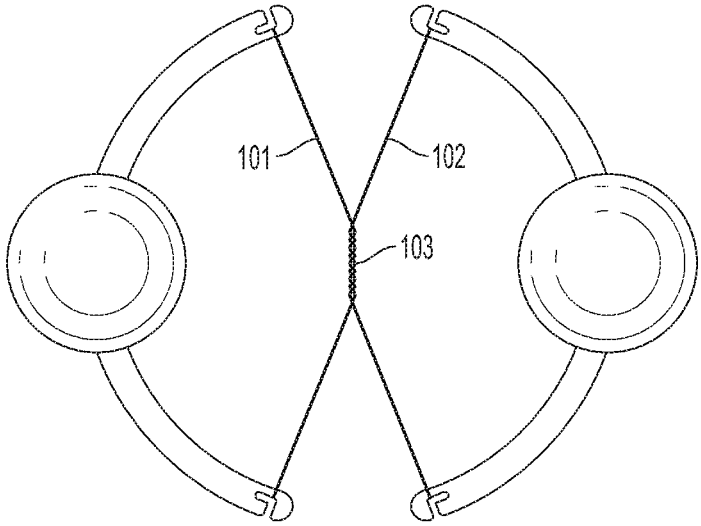
Figure 15C:
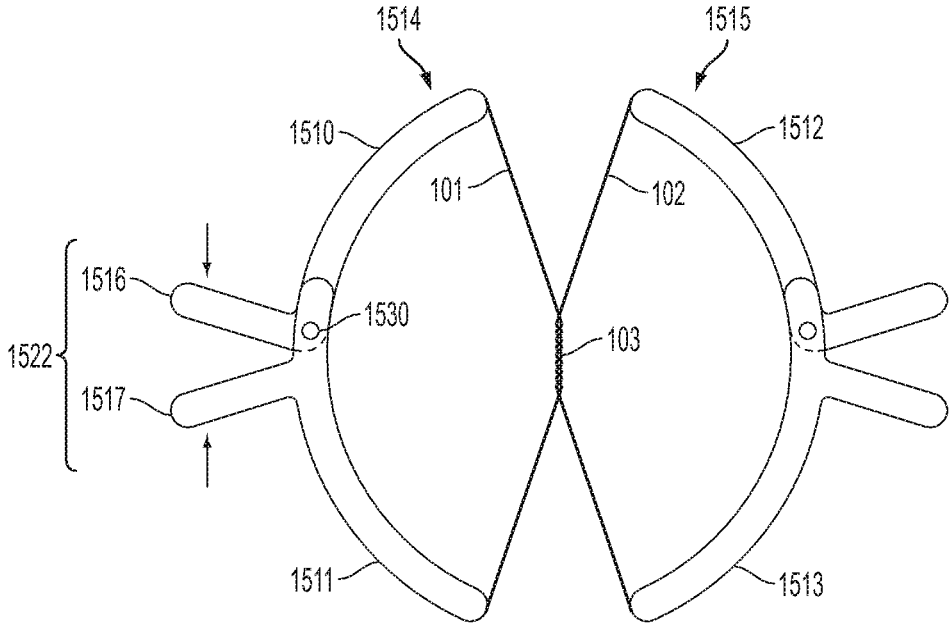

FIGS. 15A through 15C show exemplary embodiments of a structural member that may be included as a component of an apparatus for removing hair from the root. An exemplary embodiment comprises left and right elongate elements [101, 102] entwined at a common twist or coil [103] and held in tension by left and right structural members [1504, 1505] respectively, where the structural members are curved in two orthogonal planes, similarly to the double curvature illustrated in FIGS. 4A and 4B. Furthermore a central portion of each structural member may include a handle [1520] that can be easily gripped by a user. The handle may be configured in the form of a sphere (shown diagrammatically in FIG. 15B), a bar, or a collection of other shapes and/or surfaces that are suitable for enhancing a user's ability to grip the apparatus. As shown in FIG. 15C, the left and right structural members [1514, 1515] may each be formed with upper and lower portions [1510, 1511, 1512, 1513] functionally joined at a pivot [1530]. Each of the structural member upper and lower portions may include a portion [1516, 1517] that projects radially outwardly from the structural member. Together, the portions [1516, 1517] form a handle [1522] that may be operated in a manner where the portions [1516, 1517] are squeezed together and rotate about the pivot [1530]. As a result of the squeezing operation, the top and bottom ends of the member are deflected out further away from one another, thereby adjusting the tension of the elongate elements.

Figure 16A:
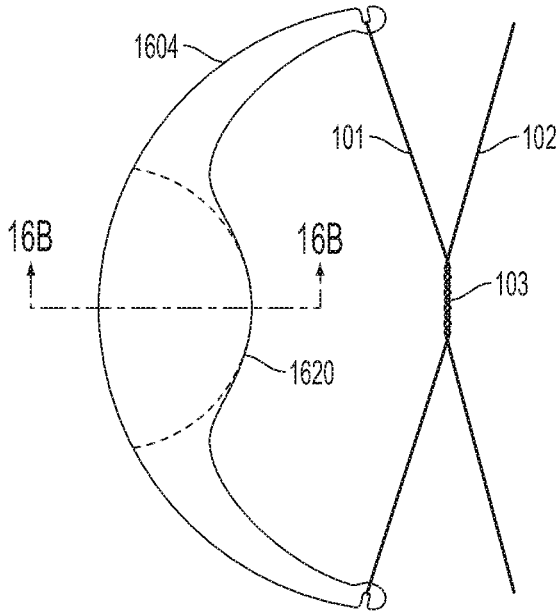
FIGS. 16A and 16B show exemplary embodiments of a structural member that may be included as part of an apparatus for removing hair.
Figure 16B:
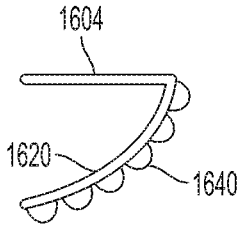

FIGS. 16A and 16B show exemplary embodiments of a structural member [1604] that may be included as part of an apparatus for removing hair from the root. The apparatus may include left and right elongate elements [101, 102] entwined and held in tension by respective left and right structural members—the right structural member optionally being a mirror image of the left structural member [1604] shown in FIG. 16A—where the structural members are curved in two orthogonal planes, similarly to the double curvature illustrated in FIGS. 4A and 4B. Additionally, a central portion of each structural member can include a protrusion [1620] such that when the structural member is positioned in close proximity to the skin and is rotated through an angle, the protrusion [1620] may come into contact with the skin and pull the skin taught to aid in hair removal. The protrusion may be made up of a curved surface with or without spherical bumps [1640] to promote point contact with the skin, thereby still allowing the structural members to be rocked back and forth as described previously in exemplary methods of removing hair. Such exemplary methods can be performed using the embodiments shown in FIG. 16. Additionally, the protrusion [1620] may comprise one or more moving parts.

In various exemplary embodiments, an apparatus for hair removal from the skin's surface may comprise two elongate elements. The elongate elements may be two individual loops or two individual lengths each consisting of a top end and a bottom end. The two elements, whether loops or lengths, are entwined with one another in a coiled manner whereby a local mutual twist is formed along the length of the two elements. Furthermore, in various exemplary embodiments, each of the elongate elements are put into and held in tension by a structural member where the top end point of the structural member dictates the location of the top end of the elongate element and the bottom end point of the structural member dictates the bottom end of the elongate element. The structural member top and bottom end points can be made up of spherically shaped "bulb" tips of suitable radius, as shown in FIG. 9B. The elongate element or "thread" can exit the structural member through a point in the spherical tip such that the thread is positioned tangentially to and in very close proximity to the skin's surface. Furthermore in various exemplary embodiments the thread exits from a point on the spherical tip such that when the thread is tensioned in use (in any prescribed direction) no interference occurs between the elongate element and structure. Further, the spherical nature of the bulb tip provides a rounded surface from all user angles to help prevent scratching the skin during operation of the apparatus in accordance with any of the methods described herein.

In various exemplary embodiments the previously described structural elements may be manufactured for disposable use using a plastic material having a suitable melting point, whereby the elongate elements are robustly attached at their ends to the structural members by a melding process, where the structural elements and elongate elements are locally melted together to form an integral unit.

In various exemplary embodiments, an apparatus for hair removal from the skin's surface may comprise two elongate elements. The elongate elements may be two individual lengths each consisting of a top end and a bottom end. The elongate elements can be entwined with one another in a coiled manner whereby a local mutual twist is formed along the length of the two elements. Furthermore, in various exemplary embodiments, the elongate elements include anchors that are attached to the ends of the elongate elements. The anchors may be made of a plastic material of suitable melting point whereby the elongate elements are robustly attached at their extreme ends to the anchors by a melding process, where the anchors and the elongate elements are locally melted together to form a strong bond between the two. The anchors may be made from a metal or wood material attached to the respective elongate element through a suitable method such as riveting. The elongate elements are put into and held in tension by the structural members via the aforementioned anchors. The top end of the structural member dictates the location of the top anchor and elongate element and the bottom end of the structural member dictates the location of the bottom anchor and therefore the bottom end of the element.

Figure 17A:
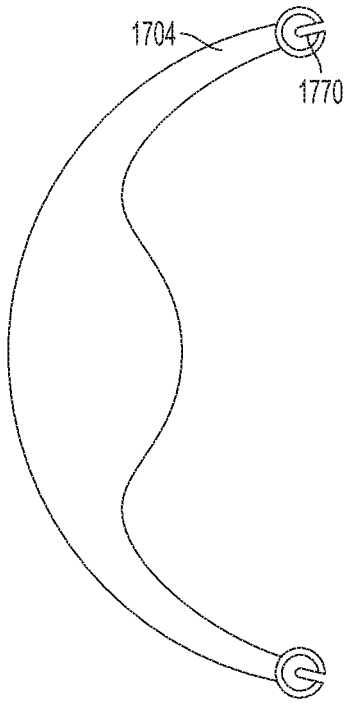
FIGS. 17A through 17C show exemplary embodiments of a structural member that may be included as a component of an apparatus for removing hair.
Figure 17B:
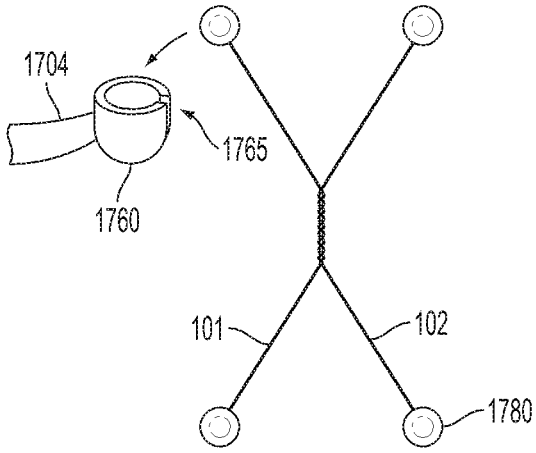

FIGS. 17A and 17B show exemplary embodiments of a structural member [1704] and elongate element assembly that may be included as a component of an apparatus for removing hair. The elongate element s [101,102] may be two individual lengths of thread or suitable material, each consisting of a top end and bottom end. The element s may include "anchor" elements [1780] at their extreme ends, where each anchor [1780] may be formed as a small mass such as a spherical ball, for example. The elongate elements [101, 102] are attached to the anchor [1780] such that they exit the anchors at a tangent to the surface of the anchor. An end of the elongate element is slotted through into an appropriately sized channel [1770, 1765] located at the top and/or bottom of the structural members [1704]. The channel [1770] is oriented such that the elongate element can be placed within the channel and will not inadvertently slip out of engagement with the channel during operation of the apparatus. Tensioning the elongate element causes the anchor [1780] to butt up against the structural member [1704], thereby further securing or anchoring the elongate element to the structural member. Alternatively, the structural member [1704] may include a retaining portion or "retainer" [1760] located at the top and/or bottom end of the structural member, the retaining portion having a channel [1765] and a cavity that is shaped complementary to the anchor [1780]—e.g., spherical—in order to hold the anchor securely during operation of the apparatus. Further, the retainer clearly dictates the side of the structural member that the elongate element should exit from, thereby preventing incorrect installation. When all four anchors are installed into the structural members the elongate elements [101, 102] are held in tension.

Figure 17C:
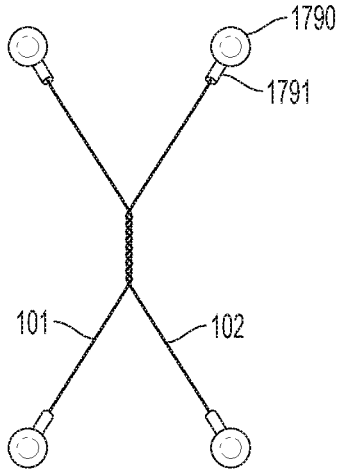

FIG. 17C show exemplary embodiment that may be included as a component of an apparatus for removing hair. The embodiment includes an elongate element and anchor assembly, where each anchor [1790] may be formed as a small mass such as a spherical ball, for example. Further, the anchor is formed to include a "neck" portion [1791]. The elongate element [101, 102] is attached to the anchor [1790] such that it exits the anchor through the neck [1791]. The neck may be cylindrical, triangular, square or rectangular in cross section, so far as the main anchor body is thicker than the neck in at least one direction. The neck serves to protect the elongate element from damage when coming into contact with the structural member exit point, which may act as a knife edge and sever the elongate element during use. Further, the thinner section of the neck provides a gap through which a structural member may engage with the anchor when the elongate elements are stacked together. See, for example, FIG. 23. The anchor can be slotted through into an appropriately sized channel [1770] which is of equal or greater thickness than the anchor neck [1791].

Figure 18A:
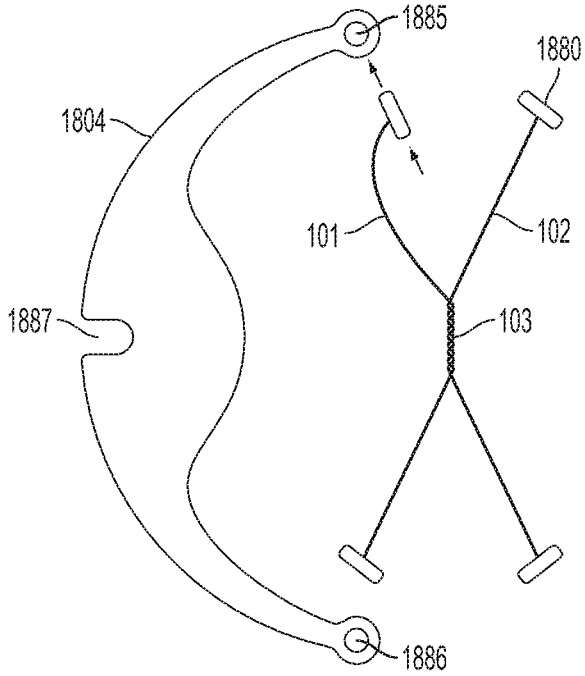
FIGS. 18A through 18C show an exemplary embodiment of a structural member that may be included as part of an apparatus for removing hair.
Figure 18B:
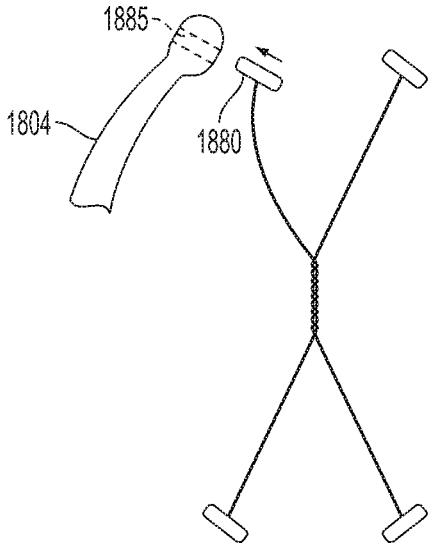
Figure 18C:
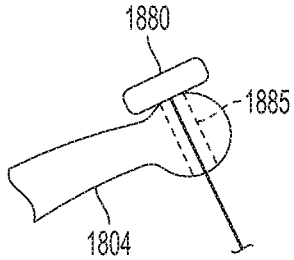

FIGS. 18A through 18C show an exemplary embodiment of a structural member [1804] that may be included as part of an apparatus for removing hair. The embodiment includes anchors [1880] that are formed as slender "tag" structures, having a relatively narrow cross section that is cylindrical, for example. The elongate element [101, 102] is attached to the anchor [1880] such that it exits the tag anchor midway along its length at an angle that is perpendicular to the length of the tag. The tag anchor [1880] is slotted into an appropriate sized hole [1885] within the structural members [1804] by orienting its narrow cross section such that the tag passes easily through the hole in the structural member, as shown in FIG. 18B. The tag [1880] is then positioned to lay along its length and up against the end of the structural member, the length of the tag being oriented perpendicular to the hole [1885] in the structural member [1804] as shown in FIG. 18C, thereby preventing the tag's exit through the hole [1885] and thus anchoring the elongate element to the structural member. Furthermore, in various exemplary embodiments the structural member [1804] may house a protective groove, such as a flange or escutcheon (not shown), to house the tag [1880] thereby preventing it from protruding beyond the periphery of the structural member.

In various exemplary embodiments the anchors may be formed with snap-on clips, such that they snap into an opening within the structural member. Alternatively, the anchors may be formed as doughnut-like rings that can be hooked onto or affixed to a clip or hook on the structural member. In another exemplary embodiment, the anchors can be formed with screw-on ends, such that they can be screwed onto a protrusion that is formed at an end of the structural member. In another exemplary embodiment, the anchors can be formed as key-like structures, such that they can be inserted into corresponding recesses or key holes in the structural member and then turned to be locked into place. The previously described anchors may be manufactured from a suitable plastic material as bead moldings with a central hole that the elongate element can be inserted into the elongate element. The 'bead and thread' configuration can then be heat treated to melt or meld the elongate element and the anchor together. In various exemplary embodiments, the anchors can be formed in any of the above mentioned ways. Furthermore, in various embodiments the anchor structure can be extended such that it includes a surface for the user to hold the anchor while securing it to the structural member.

In various exemplary embodiments, an apparatus for hair removal from the skin's surface may comprise two elongate elements. The elongate elements may be formed as two loops. In this configuration, the elongate elements are entwined with one another in a coiled manner whereby a local mutual twist is formed along the length of the two elements. Furthermore, in various exemplary embodiments, the left elongate element is attached to itself at its extreme ends to form a loop, and the right elongate element is attached to itself at its extreme end to also form a closed loop. The loops may be secured via anchors that may be made of a plastic material of suitable melting point whereby the elongate elements are robustly attached—e.g., permanently secured—to the anchors by a melding process. Alternatively the loops may be secured with a simple knot as shown, for example, in FIG. 21D or with a fastener made of metal, wood, rubber or ceramic material.

Figure 19A:
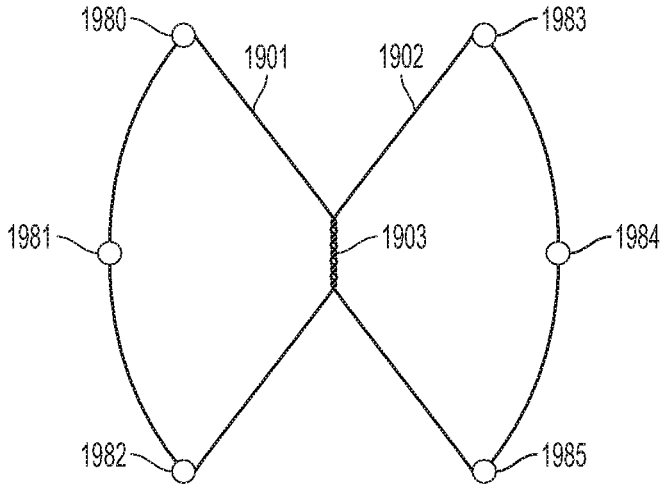
FIGS. 19A through 19D show exemplary embodiments of a structural member that may be included as part of an apparatus for removing hair.
Figure 19B:
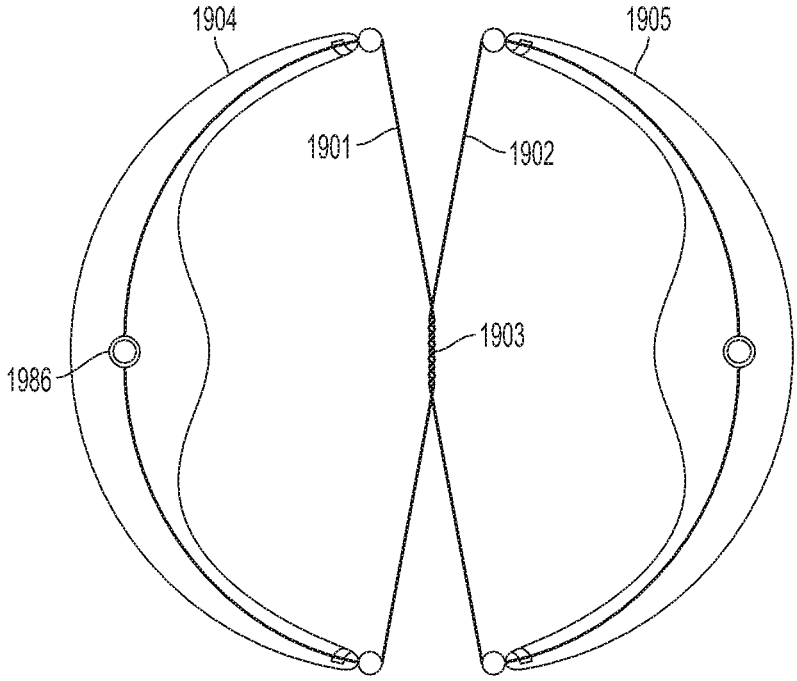

FIGS. 19A and 19B show an exemplary embodiment of a structural member [1904] and an elongate element assembly that may be included as part of an apparatus for removing hair from the root, where the apparatus comprises two elongate elements [1901, 1902] The elongate elements are entwined with one another in a coiled manner whereby a local mutual twist [1903] is formed along the length of the two elements. Furthermore, in various exemplary embodiments, the left elongate element is attached to itself at its extreme ends to form a loop via an anchor [1981], and the right elongate element is attached to itself at its extreme end to form a closed loop via an anchor [1984]. The aforementioned anchors may be made of a plastic material of suitable melting point whereby the elongate elements are robustly attached to the anchors by a melding process. Furthermore, two additional anchors [1980, 1982, 1983, 1985] are added to dictate the top and bottom locations of each of the elongate elements. The top and bottom anchors promote easy installation, where the central anchor may fit into an opening in the structural member [1986], while the user holds the top anchor [1980] and attaches it to the top position, likewise the user holds the bottom anchor [1982] and attaches it to the bottom position of the structural member [1904]. The elongate elements are put into tension by structural members [1904, 1905] as shown in FIG. 19B.

Figure 7D:
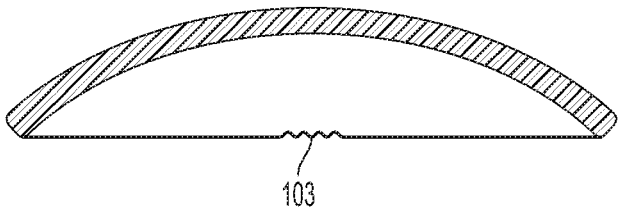
Figure 19C:
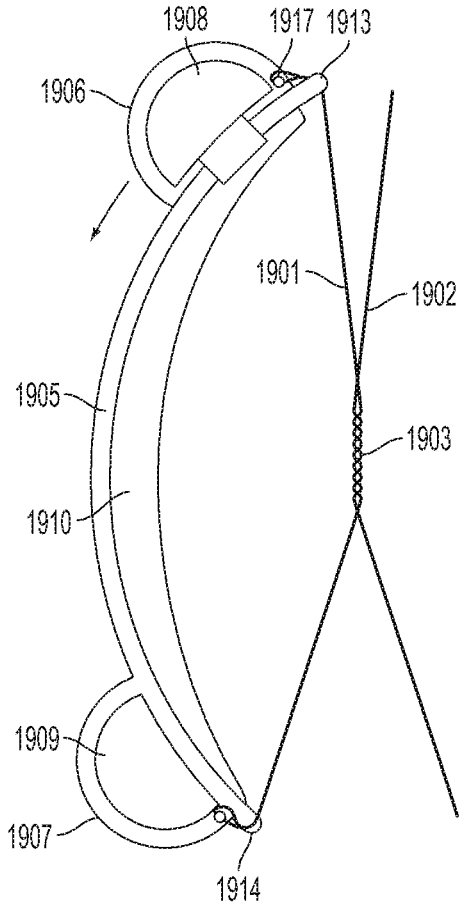
Figure 19D:
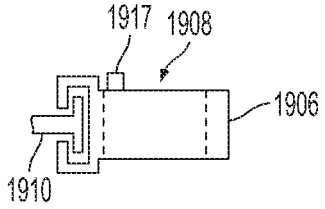

FIGS. 19C and 19D show an exemplary embodiment of a structural member [1905] that may be included as part of an apparatus for removing hair from the root, where the apparatus comprises two elongate elements [1901, 1902] entwined at a mutual coil or twist [1903]. The apparatus may further comprise a left structural member [1905], a left fixed bottom finger loop [1909] connected to the bottom of the left elongate element [1901], a left top sliding finger loop [1906] connected to the top of the left elongate element [101] via a spigot [1917], a right structural member (not shown), a right fixed bottom finger loop (not shown) connected to the bottom of the right elongate element [1902], and a right top sliding finger loop (not shown) connected to the top of the right elongate element [1902] via a spigot (not shown), where the structural members put into tension each of the elongate elements, where the top end [1913] of the structural member [1904] dictates the location of the top end of the elongate element and the bottom end [1914] of the structural member dictates the bottom end of the elongate element. The user can place a finger into a hole [1908] of the top finger loop [1906] and one finger into a hole [1909] of the fixed bottom finger loop [1907] and can then slide the loop [1906] along the body length of the structural member [1905]. The sliding action may be further supported by a sliding track [1910] formed in the structural member as shown, for example, in FIG. 19D. Sliding the left or right finger loops adjusts the tension in the elongate elements [1901, 1902], by adjusting the position of the elongate elements relative to their respective structural members. Furthermore, in various exemplary embodiments, the structural members may be curved along their length in a second orthogonal plane as shown in FIG. 7D.

Figure 20A:
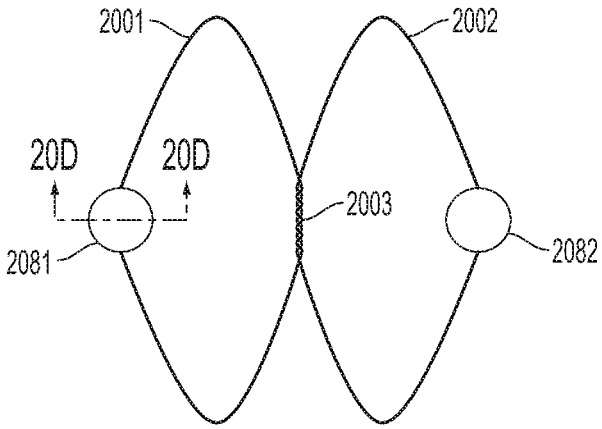
FIGS. 20A through 20D show an exemplary embodiment of a structural member that may be included as part of an apparatus for removing hair.
Figure 20B:
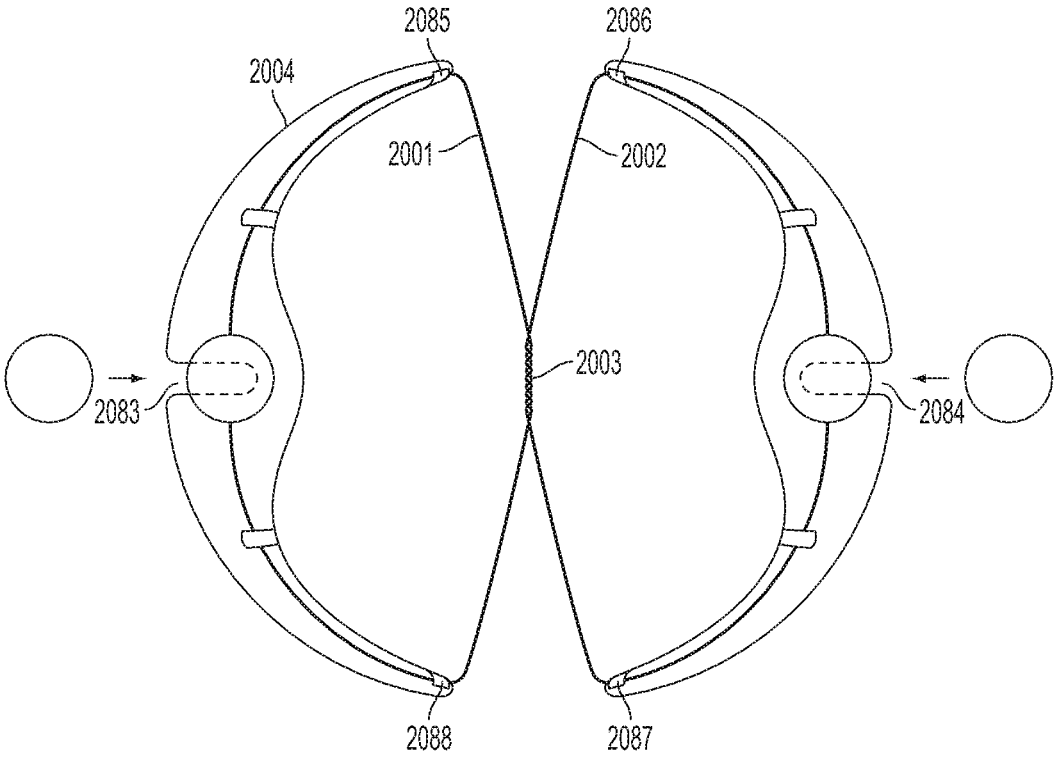
Figure 20C:
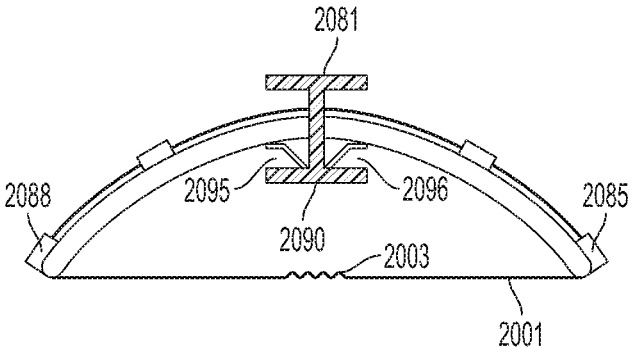
Figure 20D:
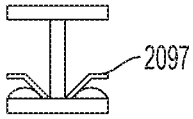

FIGS. 20A through 20D illustrate an exemplary embodiment of a structural member [2004] that may be included as part of an apparatus for removing hair. Elongate elements [2001, 2002] may be configured as two loops of thread. The elongate elements may be entwined with one another in a coiled manner whereby a local mutual twist [2003] is formed in a region along the length of the two elongate elements, as shown in FIG. 20A. Furthermore, in various exemplary embodiments, the left elongate element [2001] can be attached to itself at its extreme ends to form a closed loop via an anchor [2081], and the right elongate element [2002] can be attached to itself at its extreme ends to form a closed loop via an anchor [2082]. Central anchors [2081, 2082] may be configured to clip or slide into openings in the structural members [2083, 2084] as shown in FIGS. 20B and 20C. The elongate elements may sit within a groove [2085-2088] allowing them to exit their respective structural members at the extreme ends of the structural members. Furthermore, the central anchors [2081, 2082] may be structured to form a moving press, where the central anchors may be manipulated as a way of adjusting tension in the elongate elements as shown, for example, in FIG. 20C. The user can press the lower end [2090] of the central anchor, causing it to extend upwards, thereby pulling and tensioning elongate element [2001]. Further in various exemplary embodiments the structural member may include a spring mechanism [2095, 2096], that may serve to return the central anchor [2081] back to its original position upon release of the pressing action. Further, the anchor press may include built-in return springs [2097] as shown in FIG. 20D.

In various exemplary embodiments, an apparatus for hair removal from the skin's surface may comprise two elongate elements. The elongate elements may be two individual lengths each consisting of a top end and a bottom end. The said elongate elements may consist of anchors attached to their extreme ends. The elongate elements may be entwined with one another in a coiled manner, whereby a local mutual twist is formed along the length of the two elements. Furthermore, in various exemplary embodiments, the twist arrangement may be secured by an adhesive material or compound to prevent the twist arrangement from unraveling. The adhesive may be in the form of a local application directly to the twist. In operation of the apparatus, the adhesive would be removed and can be peeled off, for example, allowing the twist to move freely along the lengths of the elongate elements.

In various exemplary embodiments, the elongate elements may be entwined with one another in a coiled manner, whereby a local mutual twist is formed along the length of the two elements. Furthermore, in various exemplary embodiments, the elongate elements can be coated with a sticky substance, such as a gel adhesive or other similar compound, covering the length of each elongate element as well as the mutual twist arrangement. In operation of the apparatus the sticky, adhesive matter would remain on the elongate elements and serve to further grip hairs that are to be entrained in and removed by the mutual twist.

In various exemplary embodiments, the gel adhesive or other coating that is applied to the elongate element, may also be an antiseptic substance or contain antibacterial properties, to ensure hygienic conditions and to disinfect the skin's surface as hairs are pulled from the hair root during operation of the device.

Furthermore, in various exemplary embodiments, the elongate elements may be coated in a "soft touch" material to provide a cushioning effect to the skin. This may be in the form of a silicone or rubber coating, or a thick gel layer covering the length of the elongate element as well as the twist arrangement. This type of configuration would allow for relatively stronger materials to be included in a list of materials that may be used to manufacture the elongate element, without sacrificing the comfort of the person whose hairs are to be removed using the apparatus.

Figure 21A:
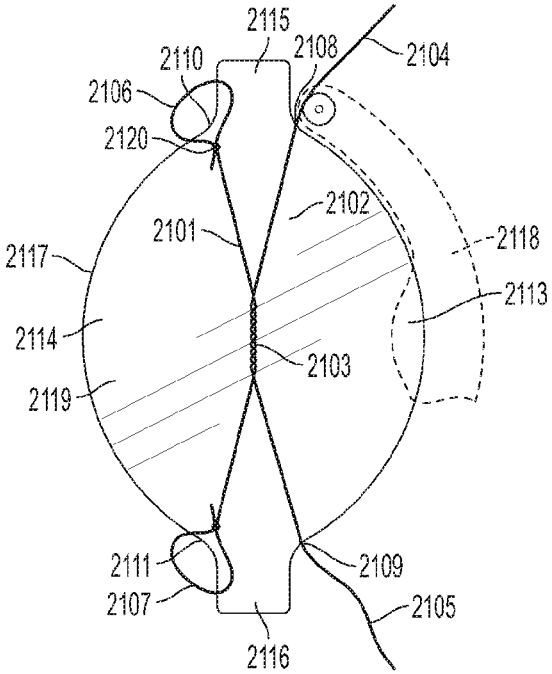
FIG. 21 shows exemplary embodiments of elements that may be included as part of an apparatus for hair removal.
Figure 21B:
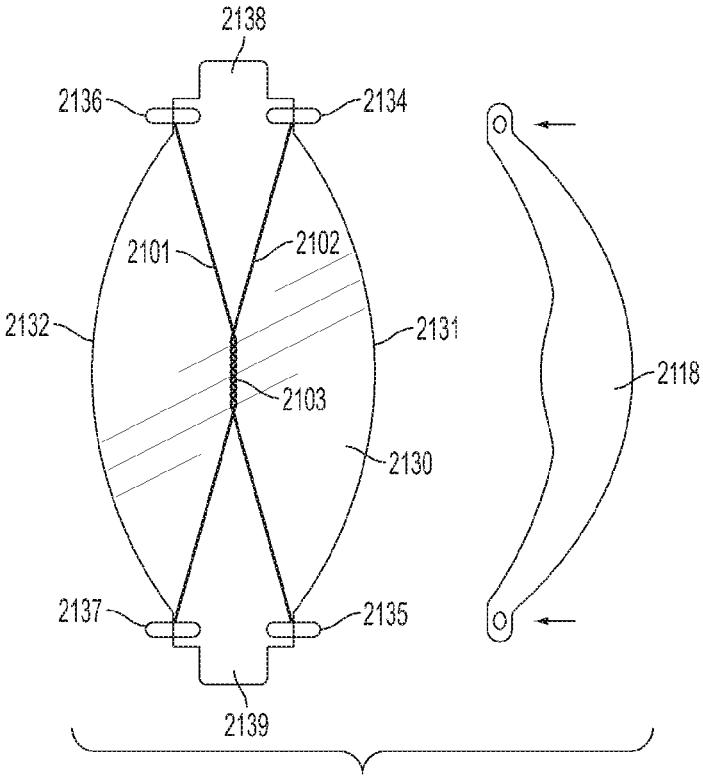

FIG. 21A shows an exemplary embodiment of elements that may be included as part of an apparatus for hair removal from a skin surface. The elongate elements [2101, 2102] may be two individual lengths of thread or other suitable material, each consisting of a top end and a bottom end. The elongate elements are entwined with one another in a coiled manner whereby a local mutual twist [2103] is formed along the length of the two elements. Furthermore, in various exemplary embodiments, the twist arrangement can be secured by an adhesive "tape" or substrate material [2119] that is applied to one or more sides of the elongate elements [2101, 2102]. The tape may be flexible or rigid in nature. If the tape is rigid, then the substrate may be configured to be flat or curved along its length. The elongate elements may include loose ends of thread length [2104, 2105] at respective extreme ends of the elongate elements. The loose ends exit the substrate at exit points [2108, 2109]. The exit points may be located at corners of the substrate [2119]. Furthermore, the elongate elements may include loop ends [2106, 2107] whereby the thread has been knotted [2120] back upon itself to form a loop at its far ends. These loops can act as anchors. The loops exit the substrate at corner points [2110, 2111]. The substrate secures the loop at the corner exit points [2110, 2111] such that the loop remains open an accessible, and can easily engage the structural members. Furthermore, the location of the exit points [2108, 2109] predetermines the length of the elongate elements when the loose ends are installed into the structural members [2118] (right hand partially shown). The applied substrate serves to ensure that the pre-twisted thread arrangement [2103] is fully secured and remains hygienic while the user attaches the loose ends [2104, 2105] or loop ends [2106, 2107] to the structural members [2118]. The substrate may have a straight or curved edge [2117]. Areas [2113, 2114]of the substrate can form a holding plate or region, where the substrate can interface with the surface of the structural member, thus allowing the user to hold both the substrate and structural member simultaneously while the ends are being attached. Protrusions [2115, 2116] may be formed from a single layer of the substrate and can be grasped by the user and tugged to remove the substrate, thus freeing the elongate element following installation. FIG. 21B shows an exemplary modification to the aforementioned embodiment, where substrate [2130]—may be applied such that it extends to secure both the elongate element arrangement as well as the anchors [2134, 2135, 2136, 2137]]. This may prevent the anchors from moving independently and can determine the best presentation angle for the anchor attachment to the structural member, thus promoting easier installation of the anchors into the structural members. The substrate may be straight or curved. Curved edges [2131, 2132] may interface with the curvature on the structural members [2118] thereby preventing incorrect installation of the elongate element assembly. Thus, an exemplary method for removing hair includes "inserting" a disposable elongate element or thread "refill" into the hair removal apparatus. When the refill attachment is complete, the tape may be tugged and removed via pull tabs [2138 or 2139] to expose the mutual twist [2103].

Figure 21C:
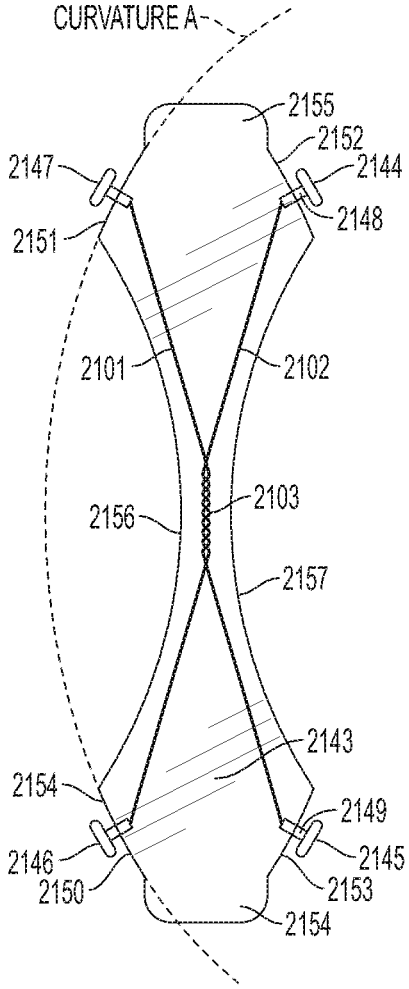
Figure 21D:
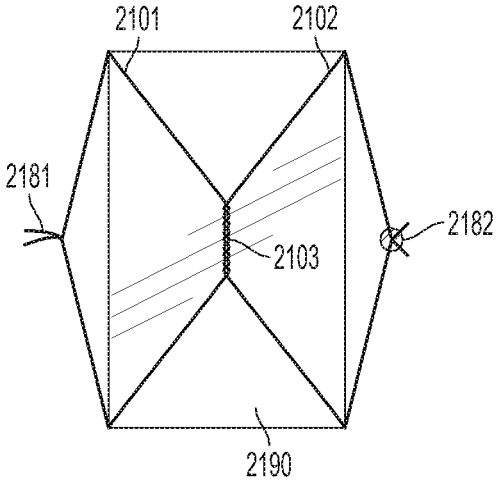

FIG. 21C shows an exemplary embodiment of elements that may be included as part of an apparatus for hair removal from a skin surface. The elongate elements [2101, 2102] may be two individual lengths of thread or other suitable material, each consisting of a top end and a bottom end. Substrate [2143] may be applied such that it extends to secure both the elongate element arrangement as well as the anchors [2144, 2145, 2146, 2147] on respective ends of the elongate elements, thus preventing the anchors from moving independently of the elongate elements and one another. The substrate presents the anchors such that an anchor neck [2148] protrudes and exits the substrate. In this configuration, the anchor neck [2148] may exit the substrate at an orthogonal or perpendicular orientation. The structural member(s) engage the anchor via a gap [2149] created between the substrate and the anchor by the neck [2148]. The substrate may be straight or curved. Curved edges [2150, 2151, 2152, 2153] form a curvature (A), which may interface with a corresponding curvature on the structural members, thereby preventing incorrect installation of the elongate element assembly. Concave edges [2156, 2157] of the substrate allow clearance for the user's thumb and fingers during installation. When the refill attachment is complete, the substrate may be tugged and removed via one or more pull tabs [2154, 2155] to expose the mutual twist [2103]. FIG. 21D shows an exemplary embodiment of elements that may be included as part of an apparatus for hair removal from a skin surface. The elongate elements [2101, 2102] may be two individual lengths of thread or other suitable material. The elongate elements are entwined with one another in a coiled manner whereby a local mutual twist is formed [2103] along the length of the two elements. Furthermore, in various exemplary embodiments, the left elongate element is attached to itself at its extreme ends to form a loop, and the right elongate element is attached to itself at its extreme end to also form a closed loop. The loops may be secured with a simple knot [2181]. Alternatively the loops may be secured via a fastener [2182] that may be made of a plastic material of suitable melting point whereby the elongate elements are robustly attached by a melding process or a fastener made of metal, wood, rubber or ceramic material. The elongate elements may include anchors attached to respective extreme ends of the elongate elements. Furthermore, in various exemplary embodiments, the twist arrangement can be secured by an adhesive substrate material [2190] that is applied to one or more sides of the elongate elements [2101, 2102]. The tape may be flexible or rigid in nature. If the tape is rigid, then the tape may be configured to be flat or curved along its length. The applied tape serves to ensure that the pre-twisted thread arrangement [2103] is fully secured and remains hygienic while the user attaches the elongate element assembly to the structural members (not shown).

Figure 21E:
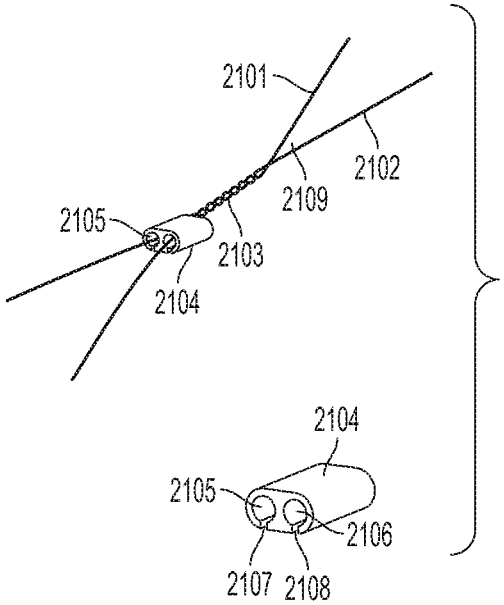

FIG. 21E shows an exemplary embodiment of elements that may be included as part of an apparatus for hair removal from a skin surface. The elongate elements [2101, 2102] may be two individual lengths of thread or other suitable material, each consisting of a top end and a bottom end. The elongate elements are entwined with one another in a coiled manner whereby a local mutual twist [2103] is formed along the length of the two elements. Furthermore, in various exemplary embodiments, a thread guard [2104] may be attached to the elongate elements [2101, 2102] on one end of the mutual twist. The thread guard is attached via thread guard slots [2107, 2108], where the elongate elements sit in the holes [2105, 2106]. The thread guard ensures that the users hairs may only be removed by entering the top end of the mutual twist [2109], thereby preventing the user from accidentally removing hairs when the mutual twist [2103] travels in the opposite direction.

Figure 22A:
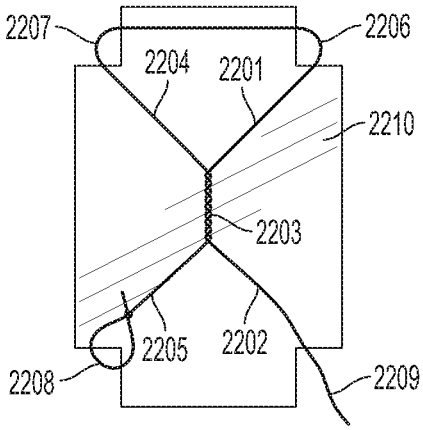
FIG. 22 shows an exemplary modification to the embodiment shown in FIG. 21.
Figure 22B:
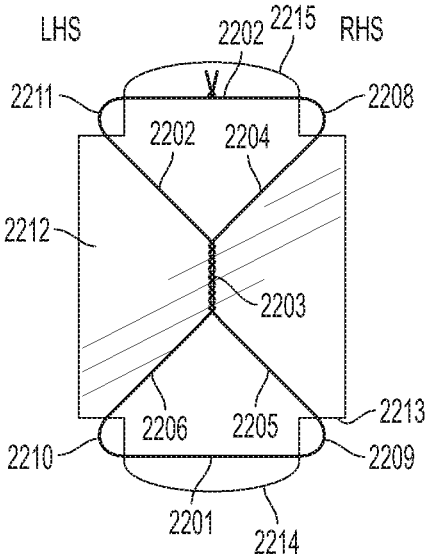

FIG. 22B shows an exemplary embodiment of elements that may be included as part of an apparatus for hair removal from a skin surface. The elongate element [2201] consists of one individual length of thread or other suitable material. The elongate element is knotted [2202] to form a loop and entwined with itself in a coiled manner, with an even number of twists such that the right hand side of the twist arrangement [2204, 2205] are a continuous length and the left hand side of the twist arrangement [2202, 2206] are a continuous length, and whereby a local mutual twist [2203] is formed along the length of the loop. Furthermore, in various exemplary embodiments, the twist arrangement can be secured by an adhesive substrate material [2212] that is applied to one or more sides of the elongate element and mutual twist [2101, 2103] creating a top end and a bottom end. The substrate material may include cutouts [2213] so as to expose portions of the loop on the right hand side [2208, 2209] and left hand side [2210, 2211] of the elongate element loop where the structural member(s) may be attached to respective extreme ends of the elongate element. The substrate serves to ensure that the pre-twisted thread arrangement [2203] is fully secured and remains hygienic and further, that the substrate presents the loop corners [2208, 2209, 2210, 2211] such that they remain open and can easily engage the structural member(s). The substrate may be tugged and removed via pull tabs [2214, 2215] to expose the mutual twist [2203].

Figure 23A:
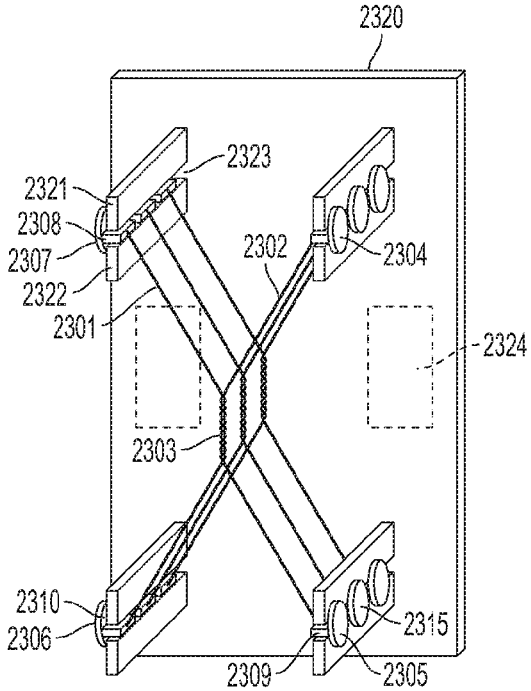
FIGS. 23A through 23E show exemplary embodiments having multiple elongate elements or threads attached to a set of structural members.

FIG. 23A shows an exemplary embodiment of elements that may be included as part of an apparatus for hair removal from a skin surface. The elongate elements [2301, 2302] may be two individual lengths of thread or other suitable material, each consisting of a top end and a bottom end. The elongate elements are entwined with one another in a coiled manner whereby a local mutual twist [2303] is formed along the length of the two elements. Furthermore, in various exemplary embodiments there may be anchor elements [2304-2307]. The anchor elements [2304] may be formed with of a thick cap [2315] and a neck [2308]. One or several elongate element assemblies can be stretched out onto a ridged tray structure [2320] where the anchors are inserted into a slot [2323] created by protruding walls [2321, 2322]. The walls and slots keep the elongate element assembly taught and present it at the correct dimensions and angle for mating with a corresponding structural member. The slot [2323] holds the neck [2308] such that it protrudes and creates a gap [2310] between an outer surface of the walls [2321, 2322] and an inner surface of the anchor cap [2315]. This configuration allows the user to align the structural member opening with the anchor necks and press downward, thereby positioning the structural member within the gap [2310] and thus installing the anchors. The user then pulls the single elongate element assembly out of the slot [2323]. Further, an adhesive patch [2324] may be applied to one or more locations on the back of the tray [2320] to allow it to be wall mounted.

Figure 23B:
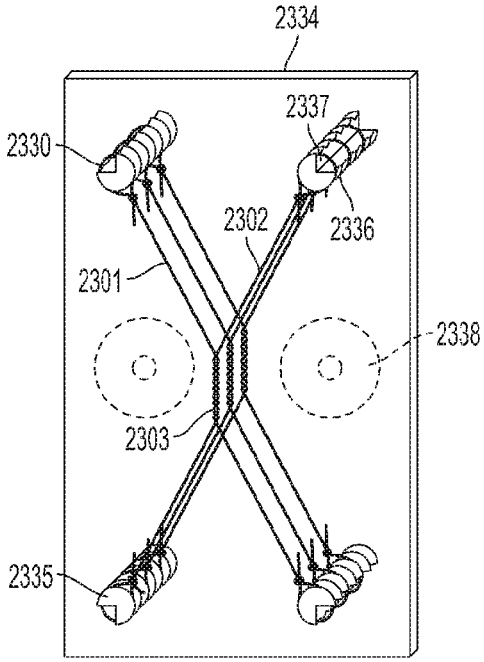
Figure 25A:
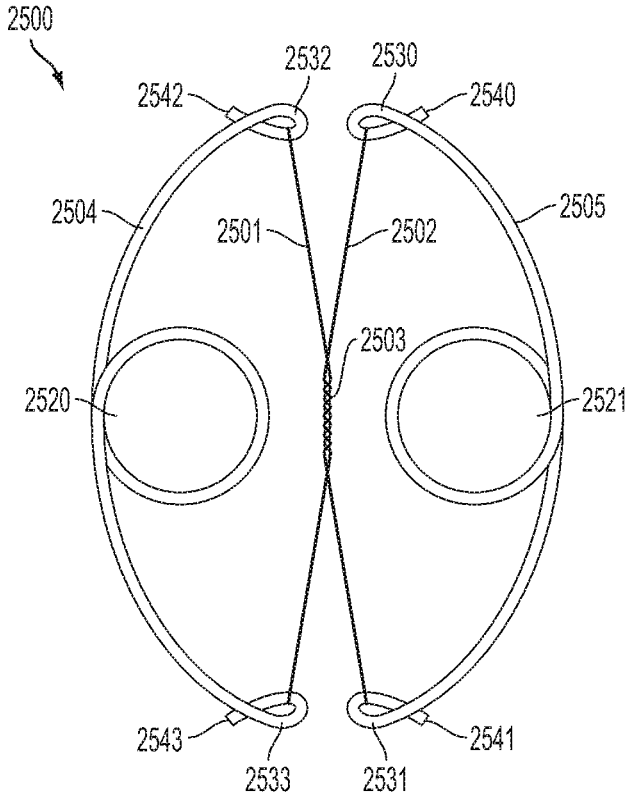
FIG. 25 shows an exemplary embodiment of an apparatus for removing hair.

FIG. 23B shows an exemplary embodiment of elements that may be included as part of an apparatus for hair removal from a skin surface. The elongate elements [2301, 2302] may be two individual lengths of thread or other suitable material, each consisting of a top end and a bottom end. The elongate elements are entwined with one another in a coiled manner whereby a local mutual twist [2303] is formed along the length of the two elements. Further, the top and bottom ends of each elongate element have loop knotted ends [2330]. One or several elongate element assemblies are stretched out onto a rigid tray structure [2334] where the loop ends are attached onto spigots or studs [2335]. The spigots keep the assembly taught and present it at the correct dimensions and orientation for proper interfacing with corresponding structural members. The spigot may have a circular cross section and alternatively, may have a non-circular cross section. Further, the spigot may have ridges [2336] that act to separate and space the elongate element assemblies from one another, and hold the assemblies in such spaced arrangement. Further, the spigots may have a cut out [2337]. The cut out creates an opening for the structural member to engage the elongate element loop [2330]. This configuration can allow the user to align the structural member openings such as [2540-2543] shown in FIG. 25A for example, with the spigot cut out and hook onto the loops [2330], thereby installing the elongate element assembly. A single elongate element assembly may then be pulled off the tray [2334]. The same tray assembly can be used to hold an elongate element assembly such as that shown in FIG. 21D. Further, an adhesive patch or suction cup [2338] may be applied to one or more locations on the back of the tray to enable wall mounting.

Figure 23C:
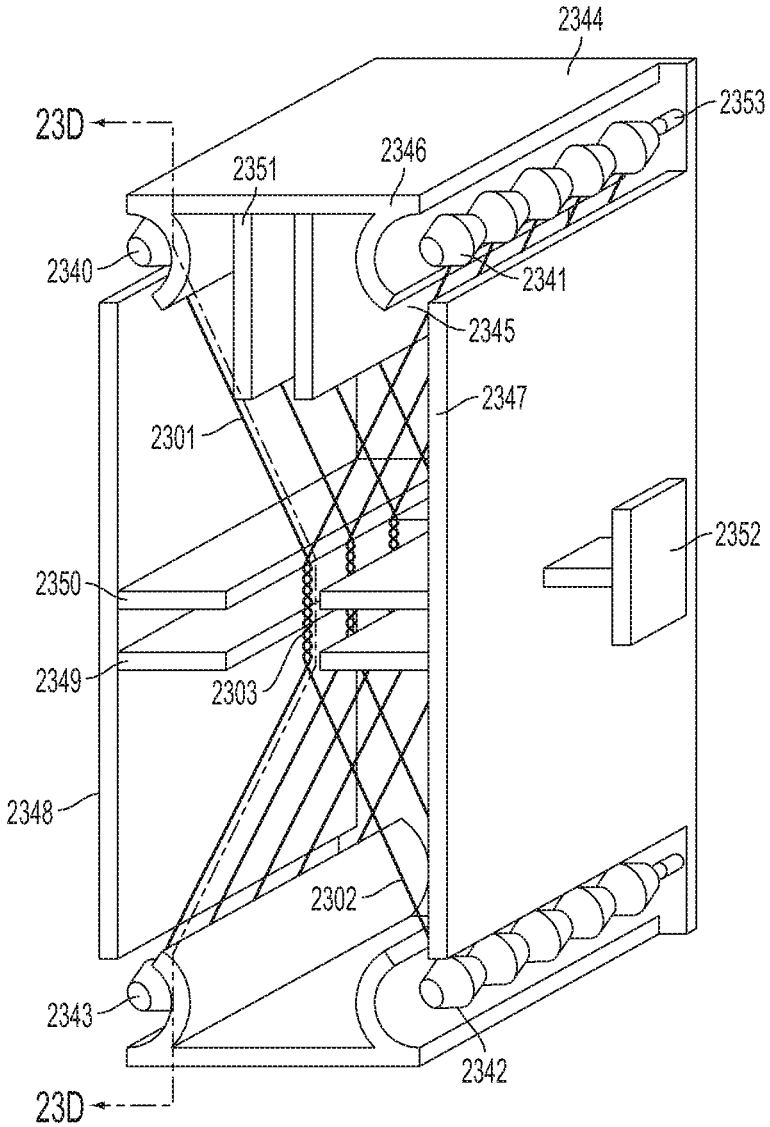
Figure 23D:
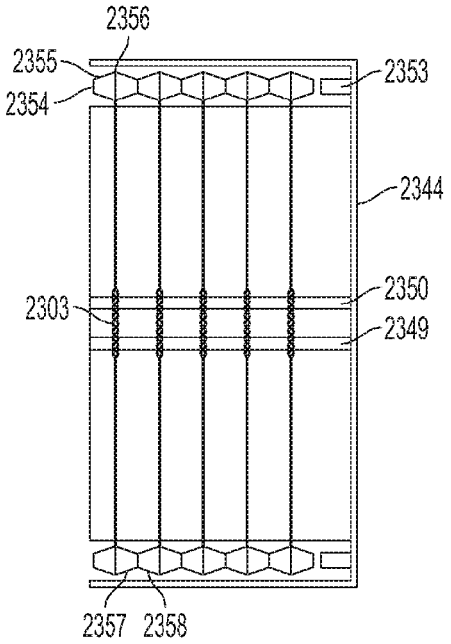

FIGS. 23C and 23D show an exemplary embodiment of elements that may be included as part of an apparatus for hair removal from a skin surface. The elongate elements [2301, 2302] may be two individual lengths of thread or other suitable material, each consisting of a top end and a bottom end. The elongate elements are entwined with one another in a coiled manner whereby a local mutual twist [2303] is formed along the length of the two elements. The top and bottom ends may have anchor elements [2340-2343]. The anchor elements may be formed as tag structures that may include a flat tip [2354], a tapered nose [2355] and a relatively thicker midsection [2356]. One or more elongate element assemblies can be stretched out onto a rigid tray structure or cartridge [2344] where the anchors are inserted into a slot [2345] created by the relative positioning of the tray walls [2346, 2347]. The flat surface [2354] of the tags allows multiple tags to be stacked in series as shown in FIG. 23D. The walls [2346, 2347] may be curved to create a "barrel" shaped structure that supports the tags when they are stacked. Further, the walls can keep the elongate element assembly taut and present it at proper orientation and dimensions for attaching to the corresponding structural member. An exemplary corresponding structural member would have holes such as those shown in FIG. 18A for example. The hole [1885, 1886] size would allow the thick mid-section [2356] to pass through the hole with the application of a pressing force, thereby allowing the user to align the structural member holes with the anchor tags. The tapered nose [2355] of the tags can act as a pilot or guide, allowing easy alignment due to the free partial insertion of the tag structure into the corresponding hole of the structural member. Following alignment of the tag structures the user can then press downward until the structural member hole has cleared the length of the first tag, the tapered end of the adjoining tag [2358] can then push the preceding tag [2357] through the hole of the structural member, without engaging itself the user can then pull up, allowing the tag to butt up against the hole, thereby pulling a single elongate element assembly out of the slot [2345]. As the user pulls the structural member up and away from the tray or cartridge [2344], the alignment of the tag structure with the hole of the structural member is altered such that the tag structure butts up against the hole without passing back through. This alignment alteration can be facilitated by slightly rocking or wiggling the structural member as it is being pulled up and away from the cartridge. Further there may be ribs [2349, 2350, 2351] that serve to protect the elongate element or thread from being interfered with as well as to provide a surface on which the user can place their thumb while pulling the assembly out of the slot [2345]. Further, there may be a protruding bracket [2352] that serves as a nesting dock or station where the structural members may be attached via a slot [1887] such as the one shown in FIG. 18A for example, when not in use. The last tag in that stack may sit upon a release spigot [2353], which could serve to push the last tag layer through the structural member hole. Further the wall of the tray [2348] may be contoured to the form of the structural members, thus allowing for finger and thumb clearance during installation.

Figure 23E:
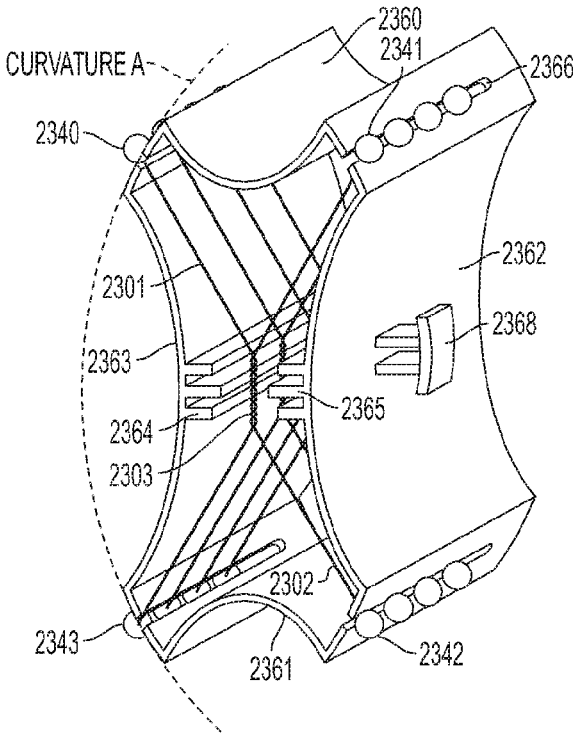

FIG. 23E shows an exemplary embodiment of elements that may be included as part of an apparatus for hair removal from a skin surface. The elongate elements [2301, 2302] may be two individual lengths of thread or other suitable material, each consisting of a top end and a bottom end. The elongate elements are entwined with one another in a coiled manner whereby a local mutual twist [2303] is formed along the length of the two elements. The top and bottom ends may have anchor elements [2340-2343]. The anchor elements may be formed as spherical structures such as those shown in FIG. 17B. One or more elongate element assemblies may be stretched out onto a rigid tray structure having four or more wall surfaces [2360, 2361, 2362, 2363] where the anchors are inserted into a corresponding slot [2366] created by the relative positioning of the walls [2360, 2361, 2362, 2363]. The walls [2360, 2361, 2362, 2363] may be curved to create a "barrel" shaped structure that supports the tags when they are stacked. Further the walls may serve to keep the assembly taut and present it at the correct orientation and dimensions for the corresponding structural member. The corresponding structural member may have slots such as those shown in FIG. 16A for example. Further there may be ribs [2364, 2365] that serve to protect the elongate element or thread from being interfered with as well as to provide a surface on which the user can place their thumb while pulling the assembly out of the slot [2366]. Further, there may be a protruding bracket [2368] that serves as a nesting dock or station where the structural members may be attached via a slot [1887] such as the one shown in FIG. 18A for example, when not in use. Further, the wall of the tray may be contoured to the form of the structural members, thus allowing for finger and thumb clearance during installation.

Figure 24A:
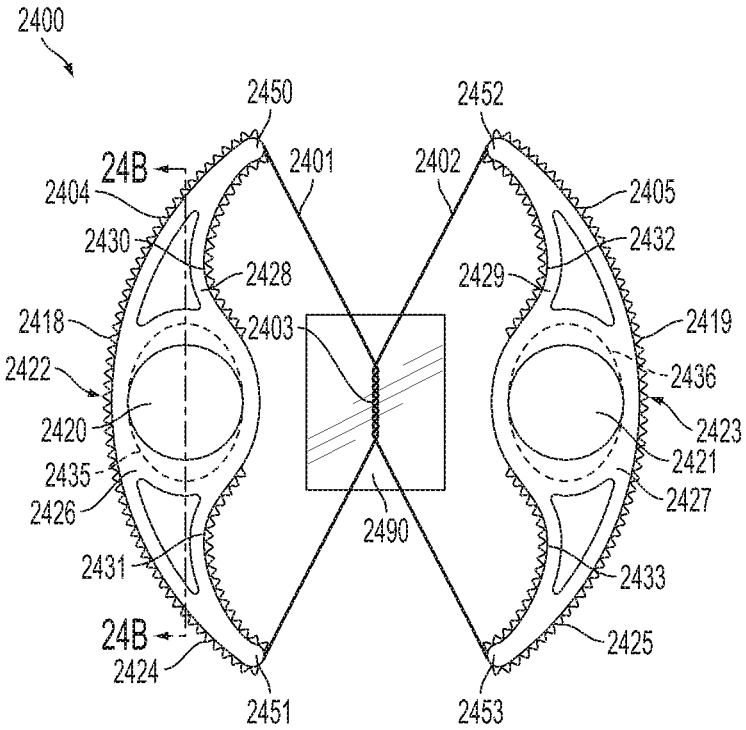
FIGS. 24A and 24B show an exemplary embodiment of an apparatus for removing hair.
Figure 24B:
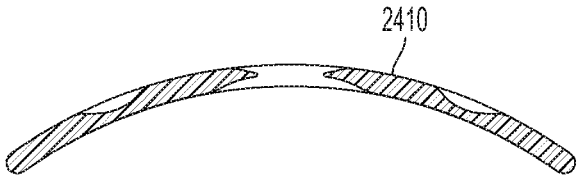

FIGS. 24A and 24B show an exemplary embodiment of an apparatus [2400] for removing hair from the root. The apparatus [2400] includes a left structural member [2404], a right structural member [2405], a left elongate element [2401], and a right elongate element [2402]. A hole [2420] is formed within a central portion of the left structural member [2404], and a hole [2421] is formed within a central portion of the right structural member [2405]. Finger grooves [2430, 2431] are formed within upper and lower portions of the left structural member, and finger grooves [2432, 2433] are formed within upper and lower portions of the right structural member. Thumb rest indentations [2435, 2436] are formed respectively, within the left and right structural members [2404, 2405]. The primary curvature of the apparatus is shown in FIG. 24A as an outer curvature [2418, 2419] of the respective left and right structural members [2404, 2405]. The secondary curvature of the apparatus is shown in FIG. 24B as curvature [2410] of left structural member [2404]; the right structural member [2405] has the same secondary curvature as the left structural member. The left and right structural members have respective leverage surfaces [2422, 2423] along their peripheries. The leverage surfaces reflect portions of the overall structural member surfaces that have been altered to include projections or other suitable surface features to provide the user with greater leverage and traction when rotating, rocking, or otherwise maneuvering the apparatus during its operation. Tactile edge indentations [2424, 2425] are included on respective left and right structural members [2404, 2405]. Surface treatments [2426, 2427] have been applied to central surface portions of the respective left and right structural members. Additionally, such surface treatments could be applied to the entire surfaces of the left and right structural members. Structural crossbeams [2428, 2429] are included as part of the respective left and right structural members. Bulb tips [2450-2453] are provided at the top and bottom ends of the left and right structural members. The ends of the elongate elements [2401, 2402] are melded with the bulb tips at the top and bottom of the respective left and right structural members; the elongate elements are thus held in tension. A mutual twist or coil [2403] is formed along a portion of the length of the left and right elongate elements [2401, 2402]. Tape adhesive [2490] is provided for securing the mutual twist [2403].

As is shown in FIGS. 24A and 24B, the structural members are curved in a primary plane—as shown in FIG. 24A—and then a secondary deflection or curvature offsets the structural member into a position away from the primary plane, thus forming a double curvature as shown in FIG. 24B. The primary curvature allows room for the user's fingers to ergonomically grip the structural members, while the secondary curvature offsets the elongate element arrangement away from the plane. This form allows the element assembly to protrude in an offset plane from the user's fingers, thus providing improved access to the skin by the element assembly. Furthermore, in various exemplary embodiments the curvatures serve to follow the general contours of a face and provide vital clearance for the nose, lips, ears, and neck when used on facial hair. Furthermore, in various exemplary embodiments due to the double curvature and surface, rotating the handles adjusts the thread tension. An exemplary method of removing hair includes causing a rocking motion of the two structural members while the elongate elements are in tension, where the bottom end of one member is brought closer to the bottom end of the second member such that the entwined coil to travels to the bottom ends of the said elements. Likewise, when the top end of one member is brought closer to the top end of the second member the entwined coil to travels to the top ends of the said elements.

Figure 25B:
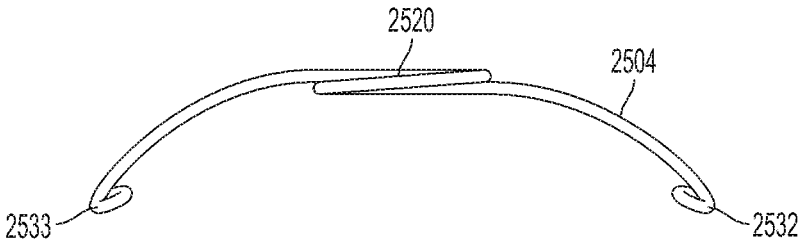

FIG. 25 shows another exemplary embodiment of an apparatus [2500] for removing hair from the root. The apparatus [2500] includes a left structural member [2504], and a right structural member [2505]. The left and right structural members may be wireform elements. A loop [2520] can be formed within a central portion of the left structural member by twisting the wireform structure upon itself to form a large torsion spring like structure, as shown in FIG. 25B. Similarly, a loop [2521] can be formed within the right structural member. The structure being formed in this manner can cause the structural members to act as torsion springs, with the extreme ends [2530-2533] therefore being compressible. The structural members [2504, 2505] hold the elongate element assembly [2501-2503] in tension. The loops [2520, 2521] can be used as thumb rests or indentations. Structural member openings [2540, 2541, 2542, 2543] are formed on the outer edge of the structural members and can ensure proper positioning and installation of elongate element assemblies such as those shown in FIG. 23B, for example.

Figure 26:
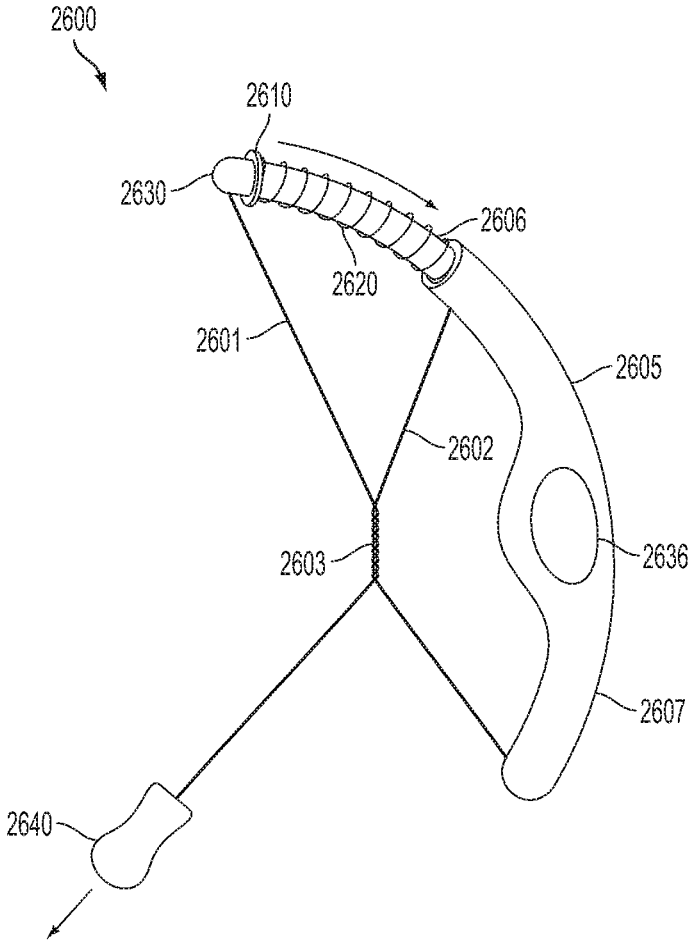
FIG. 26 shows an exemplary embodiment of an apparatus for removing hair.

FIG. 26 shows an exemplary embodiment of an apparatus [2600] for removing hair from the root. The apparatus may include two elongate elements [2601, 2602] entwined at a mutual twist [2603], and may further include a structural member [2605] having an inner portion [2606] and an outer portion [2607]. The inner and outer structural member portions may be straight or may be formed with concentric curvatures. Further, the cross section of the inner and outer portions may be non-circular, where the outer structural member portion [2607] is arranged in a coaxial manner with respect to the inner structural member portion [2606]. The apparatus [2600] may further include a ring or collar [2610] configured and arranged for sliding along the length of the inner structural member portion [2606]. A spring [2620] may be placed along the length of the inner structural member portion [2606] to bias the collar [2610] toward an extreme end [2630] of the inner structural member portion. The extreme end of the inner structural member portion may have a relatively larger cross section or may include a projection or other suitable stop feature (not shown) to prevent the collar [2610] from sliding completely off the extreme end. The apparatus may further include a knob or tab [2640] affixed to a lower end of left elongate element [2601]. An exemplary method of removing hair includes holding the structural member [2605] and applying a pulling force on knob [2640] while the elongate elements [2601, 2602] are held in tension, such that the collar [2610] moves along the length of the inner structural member portion [2606] away from the extreme end [2630] and toward the outer structural member portion [2607], thus compressing the spring [2620], and the entwined coil [2603] travels toward the top ends of the elongate elements. Likewise, when the pulling force on the knob [2640] is relaxed, the spring [2620] pushes the collar [2610] toward the extreme end [2630] and away from the outer structural member portion [2607], and the entwined coil [2603] is made to travel toward the bottom ends of the elongate elements, thereby removing entrained hair from the follicle or root. As shown in FIG. 26, thumb rest indentations [2636] can be formed within the structural member [2605]. Leverage compression surfaces (not shown) can also be formed within the structural member. Further, tactile edge indentations (not shown) may be included on the structural member [2605].

It is, therefore, apparent that there is provided in accordance with the present invention, an apparatus and method for removing hair from the surface area of skin. While this invention has been described in conjunction with a number of embodiments, it is evident that many alternatives, modifications and variations would be or are apparent to those of ordinary skill in the applicable arts. Accordingly, applicant intends to embrace all such alternatives, modifications, equivalents and variations that are within the spirit and scope of this invention.

The invention claimed is:

1. An apparatus for removing hair, comprising:

a first structural member having a first end portion and a second end portion;

a second structural member having a first end portion and a second end portion;

a first elongate element secured to the first and second end portions of the first structural member;

a second elongate element separate from said first elongate element and secured to the first and second end portions of the second structural member;

said first elongate element and said second elongate element each have a portion thereof arranged in mutually twisted relation; and wherein said first structural member is connected to said second structural member solely by said mutually twisted portions.

2. The apparatus of claim 1, wherein the first elongate element includes a closed loop in engagement with a positioning element disposed in each of the first end portion and the second end portion of the first structural member, and the second elongate element includes a closed loop in engagement with a positioning element disposed in each of the first end portion and the second end portion of the second structural member.

3. The apparatus of claim 2, wherein at least a portion of the first elongate element is received within a groove formed in the first structural member, and at least a portion of the second elongate element is received within a groove formed in the second structural member.

4. The apparatus of claim 2, wherein the first structural member is curved along at least a portion of its length in at least one of two orthogonal planes, and the second structural member is curved along at least a portion of its length in at least one of two orthogonal planes.

5. The apparatus of claim 4, wherein the first and second structural members are formed using a material selected from the group consisting of wood, metal, ceramics, carbon fiber, and plastic.

6. The apparatus of claim 4, wherein the first and second elongate elements are formed using a material selected from the group consisting of metal, polymer, cotton, bamboo, hemp, and silk.

7. The apparatus of claim 1, wherein the first elongate element having a first end and a second end, the first and second ends secured respectively to the first end portion and the second end portion of the first structural member, and the second elongate element having a first end and a second end, the first and second ends secured respectively to the first end portion and the second end portion of the second structural member.

8. The apparatus of claim 7, wherein the first and second ends of the first elongate element include respective first and second anchors for securing the first elongate to the first structural member, and the first and second ends of the second elongate element include respective first and second anchors for securing the second elongate to the second structural member.

9. The apparatus of claim 8, wherein the first and second anchors are each formed as a tag, ball, ring, clip, screw, or key, and removably engage respective first and second end portions of the first and second structural members.

10. The apparatus of claim 9, wherein the first and second anchors are formed using a material selected from the group consisting of wood, metal, ceramics, carbon fiber, and plastic.

11. The apparatus of claim 7, wherein the first structural member is curved along at least a portion of its length in at least one of two orthogonal planes, and the second structural member is curved along at least a portion of its length in at least one of two orthogonal planes.

12. The apparatus of claim 7, wherein the first and second ends of the first and second elongate elements are integrally formed with their respective structural members.

13. The apparatus of claim 12, wherein the first and second structural members are formed using a material selected from the group consisting of wood, metal, ceramics, carbon fiber, and plastic.

14. The apparatus of claim 12, wherein the first and second elongate elements are formed using a material selected from the group consisting of metal, polymer, cotton, bamboo, hemp, and silk.

15. A method of removing hair from a surface area, comprising:

providing a first structural member having a first end portion, a second end portion, and a central portion disposed between the first and second end portions thereof;

providing a second structural member having a first end portion, a second end portion, and a central portion disposed between the first and second end portions thereof;

providing a first elongate element secured to the first and second end portions of the first structural member;

providing a second elongate element separate from said first elongate element and secured to the first and second end portions of the second structural member, the first elongate element and the second elongate element each having a portion thereof arranged in mutually twisted relation and said first structural member is connected to said second structural member solely by said mutually twisted portions;

placing and holding the mutually twisted portions of the first and second elongate elements near the surface area from which the hair is to be removed, while supporting the central portions of the first and second structural members;

moving the first end portions of the first and second structural members toward each other, while simultaneously moving the second end portions of the first and second structural numbers away from each other, causing the mutually twisted portions of the first and second elongate elements to translate toward the first end portions of the first and second structural members and thus entangle, entrain, remove, and discard hairs from the surface area; and moving the first end portions of the first and second structural members away from each other, while simultaneously moving the second end portions of the first and second structural members toward each other, causing the mutually twisted portions of the first and second elongate elements to translate toward the second end portions of the first and second structural members and thus entangle, entrain, remove, and discard hairs from the surface area.

16. The method of claim 15, wherein the first elongate element includes a closed loop in engagement with a positioning element disposed in each of the first end portion and the second end portion of the first structural member, and the second elongate element includes a closed loop in engagement with a positioning element disposed in each of the first end portion and the second end portion of the second structural member.

17. The method of claim 16, wherein at least a portion of the first elongate element is received within a groove formed in the first structural member, and at least a portion of the second elongate element is received within a groove formed in the second structural member.

18. The method of claim 16, wherein the first structural member is curved along at least a portion of its length in at least one of two orthogonal planes, and the second structural member is curved along at least a portion of its length in at least one of two orthogonal planes.

19. The method of claim 15, wherein the first and second structural members are each formed with one or more of flat tactile surfaces, curved tactile surfaces, protruding bumps, finger holes, finger grooves, indentations, thumb rests, crossbars, and protruding handles, thus improving the ability of the structural members to be gripped and maneuvered.

20. The method of claim 19, wherein the one or more of flat tactile surfaces, curved tactile surfaces, protruding bumps, finger holes, finger grooves, indentations, thumb rests, crossbars, and protruding handles is disposed proximal the center portions of the first and second structural members.

21. The method of claim 19, wherein the first and second structural members are formed with surface treatments to increase traction, thus further improving the ability of the structural members to be gripped and maneuvered.

22. The method of claim 15, wherein the first elongate element having a first end and a second end, the first and second ends secured respectively to the first end portion and the second end portion of the first structural member, and the second elongate element having a first end and a second end, the first and second ends secured respectively to the first end portion and the second end portion of the second structural member.

23. The method of claim 22, wherein the first structural member is curved along at least a portion of its length in at least one of two orthogonal planes, and the second structural member is curved along at least a portion of its length in at least one of two orthogonal planes.

24. The method of claim 22, wherein the first and second ends of the first and second elongate elements are integrally formed with their respective structural members.

25. The method of claim 15, wherein the first and second structural members include means for adjusting and maintaining tension in the first and second elongate elements.

26. The method of claim 25, wherein the means includes adjusting relative positions of the first and second end portions of each structural member.

27. The method of claim 25, wherein the means includes adjusting positions of the first and second elongate elements relative to their respective first and second structural members.

28. The method of claim 25, wherein the means includes one or more of adjustable anchor elements, pivots in the structural members, crossbars depending from the structural members, notches in the structural members, telescoping portions of the structural members, sliding portions of the structural members, and spring tensioning of the elongate elements.

* * * * *